US010286988B2

(12) United States Patent
Suzuki

(10) Patent No.: US 10,286,988 B2
(45) Date of Patent: May 14, 2019

(54) OUTBOARD MOTOR AND MARINE VESSEL

(71) Applicant: YAMAHA HATSUDOKI KABUSHIKI KAISHA, Iwata-shi, Shizuoka (JP)

(72) Inventor: Kaname Suzuki, Shizuoka (JP)

(73) Assignee: YAMAHA HATSUDOKI KABUSHIKI KAISHA, Shizuoka (JP)

( * ) Notice: Subject to any disclaimer, the term of this patent is extended or adjusted under 35 U.S.C. 154(b) by 0 days.

(21) Appl. No.: 15/820,502

(22) Filed: Nov. 22, 2017

(65) Prior Publication Data

US 2018/0178892 A1 Jun. 28, 2018

(30) Foreign Application Priority Data

Dec. 28, 2016 (JP) ..... 2016-254854

(51) Int. Cl.

| | |
|---|---|
| ***B63H 20/24*** | (2006.01) |
| ***B63H 20/28*** | (2006.01) |
| ***F01P 3/20*** | (2006.01) |
| ***F01P 3/02*** | (2006.01) |
| ***F01P 3/16*** | (2006.01) |
| ***F02F 1/38*** | (2006.01) |
| *F02B 61/04* | (2006.01) |
| *F02B 75/22* | (2006.01) |
| *F02F 1/24* | (2006.01) |

(52) U.S. Cl.

CPC ..... *B63H 20/24* (2013.01); *B63H 20/28* (2013.01); *F01P 3/02* (2013.01); *F01P 3/16* (2013.01); *F01P 3/202* (2013.01); *F02F 1/38* (2013.01); *F01P 2003/024* (2013.01); *F02B 61/045* (2013.01); *F02B 75/22* (2013.01); *F02F 1/242* (2013.01)

(58) Field of Classification Search

CPC ..... B63H 20/24; B63H 20/28; F01P 3/202; F02B 61/045; F02B 75/22

See application file for complete search history.

(56) References Cited

U.S. PATENT DOCUMENTS

| | | | | |
|---|---|---|---|---|
| 6,418,905 | B1 * | 7/2002 | Baudlot | F02B 17/005 123/301 |
| 2005/0098145 | A1 | 5/2005 | Tsuchida et al. | |
| 2006/0032478 | A1 | 2/2006 | Tayama et al. | |
| 2011/0195620 | A1 * | 8/2011 | Davis | B63H 20/14 440/75 |
| 2012/0298074 | A1 | 11/2012 | Watanabe et al. | |
| 2016/0257391 | A1 | 9/2016 | Nakayama et al. | |

FOREIGN PATENT DOCUMENTS

| | | |
|---|---|---|
| JP | 2012-241698 A | 12/2012 |
| JP | 2016-160836 A | 9/2016 |

* cited by examiner

*Primary Examiner* — Stephen P Avila
(74) *Attorney, Agent, or Firm* — Keating and Bennett, LLP

(57) ABSTRACT

An outboard motor includes an internal combustion engine. The internal combustion engine includes a cylinder head including a fuel injector including an injection portion, and an ignition including an ignition portion that provides ignition within a combustion chamber. The ignition portion is deviated in an upward-downward direction, in which a valve actuating shaft extends, with respect to the injection portion in a central region of the combustion chamber. The ignition is mounted in the cylinder head.

20 Claims, 7 Drawing Sheets

OUTBOARD MOTOR AND MARINE VESSEL

CROSS REFERENCE TO RELATED APPLICATIONS

This application claims the benefit of priority to Japanese Patent Application No. 2016-254854 filed on Dec. 28, 2016. The entire contents of this application are hereby incorporated herein by reference.

BACKGROUND OF THE INVENTION

1. Field of the Invention

The present invention relates to an outboard motor and a marine vessel, and more particularly, it relates to an outboard motor including an internal combustion engine including a fuel injector that injects fuel into a combustion chamber and a marine vessel including the outboard motor.

2. Description of the Related Art

An internal combustion engine that is a direct-injection engine that directly supplies liquid fuel to a combustion chamber to increase its output and fuel economy is known in general. Such an internal combustion engine is disclosed in Japanese Patent Laid-Open No. 2012-241698, for example.

Japanese Patent Laid-Open No. 2012-241698 discloses a four-cycle engine (internal combustion engine) housed in a cowling of a marine vessel propulsion device and including a cylinder head including an intake opening through which intake air is introduced into a combustion chamber and an exhaust opening through which exhaust gas is discharged from the combustion chamber. A fuel injector that injects fuel into the combustion chamber and a spark plug that provides ignition within the combustion chamber by generating a spark in the combustion chamber are mounted in the cylinder head of the four-cycle engine disclosed in Japanese Patent Laid-Open No. 2012-241698. The spark plug is mounted in the cylinder head so as to extend along an axial direction in which a cylinder of the four-stroke engine extends. The tip of the spark plug is disposed at the center of the combustion chamber between the intake opening and the exhaust opening. The fuel injector is mounted in the cylinder head at an angle with respect to the axial direction in which the cylinder extends. The tip of the fuel injector is spaced apart from the axis (the center of the combustion chamber) beyond the intake opening in the combustion chamber, and the fuel injector is disposed below an intake valve that opens and closes the intake opening.

In a direct-injection engine, it is necessary to homogenously mix injected fuel and air in a combustion chamber and burn the mixture at a high speed in order to increase the combustion efficiency. Therefore, it is necessary to dispose a fuel injector at a position at which fuel and air are uniformly mixed, such as on a bore centerline that passes through the combustion chamber, an intake opening, and an exhaust opening, and cause the fuel injector to inject fuel in an appropriate direction. Techniques for rapid combustion include disposing a spark plug near the center of the combustion chamber to create a flame front on a substantially concentric circle from the center of the combustion chamber, and two-point ignition performed by disposing a plurality of spark plugs in the combustion chamber, etc.

Furthermore, in order to dispose an assembly including a four-cycle engine, an intake system, etc. in a limited space inside a cowling of an outboard motor, it is necessary to downsize the assembly.

In an outboard motor including the four-cycle engine disclosed in Japanese Patent Laid-Open No. 2012-241698, the fuel injector is disposed below the intake valve and, thus, the fuel injector is likely to interfere with another member that the outboard motor includes. In the case in which the four-cycle engine disclosed in Japanese Patent Laid-Open No. 2012-241698 is a V-type engine in which an intake pipe of an intake system is disposed outside the four-cycle engine, for example, when the fuel injector is disposed below the intake pipe, it is necessary to increase a protrusion of the intake pipe in order to prevent interference between an intake port that communicates with the intake opening and the fuel injector. Thus, the width of the entire outboard motor is increased, which increases the size of the outboard motor. Particularly when a plurality of outboard motors are disposed in a width direction, the outboard motors are likely to interfere with each other such that it is difficult to dispose the plurality of outboard motors in the width direction.

When the fuel injector is disposed near the center of the combustion chamber in order to significantly reduce or prevent an increase in the size of the outboard motor and the difficulty in disposing the plurality of outboard motors in the width direction, the spark plug is also disposed near the center of the combustion chamber. Thus, the fuel injector and the spark plug interfere with each other, and a valve actuator that transmits a drive force to a valve is also likely to interfere with the fuel injector and the spark plug. Therefore, in an internal combustion engine of an outboard motor, it is desired to dispose a fuel injector and an ignition such that a favorable flame front is created while an air-fuel mixture distribution is homogenized such that constraints on the shape and layout of a valve actuator are reduced.

SUMMARY OF THE INVENTION

Preferred embodiments of the present invention provide an outboard motor including an internal combustion engine in which a fuel injector and an ignition are disposed such that a favorable flame front is created while an air-fuel mixture distribution is homogenized such that constraints on the shape and layout of a valve actuator are significantly reduced, and a marine vessel including the outboard motor.

An outboard motor according to a preferred embodiment of the present invention includes an internal combustion engine, a cowling in which the internal combustion engine is housed, and a propulsion unit that converts a rotational drive force of the internal combustion engine into a thrust force. The internal combustion engine includes a cylinder head including an intake opening through which intake air is introduced into a combustion chamber of a cylinder and an exhaust opening through which exhaust gas is discharged from the combustion chamber, a plurality of valves that open and close the intake opening and the exhaust opening, a pair of valve actuators provided for the cylinder head, each including a valve actuating shaft, and that transmit a drive force to the plurality of valves, a fuel injector mounted in the cylinder head and including an injection portion that injects fuel from a central region of the combustion chamber between the intake opening and the exhaust opening into the combustion chamber, and an ignition mounted in the cylinder head and including an ignition portion deviated in an upward-downward direction, in which the valve actuating shaft extends, with respect to the injection portion in the central region and that provides ignition within the combustion chamber.

In an outboard motor according to a preferred embodiment of the present invention, the injection portion and the ignition portion that provides ignition within the combustion chamber are disposed in the central region of the combustion chamber between the intake opening and the exhaust opening. Thus, the injection of fuel is performed in the central region of the combustion chamber, and liquid fuel is appropriately injected such that the fuel is evenly distributed in the combustion chamber. Consequently, the distribution of an air-fuel mixture produced by mixing the fuel and the intake air is homogenized in the combustion chamber. In addition, the air-fuel mixture homogenized in the combustion chamber is ignited in the central region of the combustion chamber. As a result, the combustion in the combustion chamber more uniformly propagates, and a favorable flame front is created. Therefore, in the internal combustion engine, the fuel injector and the ignition are disposed such that a favorable flame front is created while the air-fuel mixture distribution is homogenized, and the combustion efficiency of the internal combustion engine is improved.

In an outboard motor according to a preferred embodiment of the present invention, the ignition portion is deviated in the upward-downward direction, in which the valve actuating shaft extends, with respect to the injection portion in the central region of the combustion chamber between the intake opening and the exhaust opening. When the ignition portion and the injection portion are aligned in a direction perpendicular or substantially perpendicular to the upward-downward direction in which the valve actuating shaft extends, it is necessary to ensure a distance between the intake opening and the exhaust opening in order to significantly reduce or prevent interference of the ignition and the fuel injector with components mounted in the cylinder head such as the valve actuators. Thus, the distance between the intake opening and the exhaust opening increases, and an angle (setting angle) between the valve that opens and closes the intake opening and the valve that opens and closes the exhaust opening increases. Therefore, the size of the internal combustion engine increases in the direction perpendicular or substantially perpendicular to the upward-down direction in which the valve actuating shaft extends. According to a preferred embodiment of the present invention, the ignition portion is deviated in the upward-downward direction, in which the valve actuating shaft extends, with respect to the injection portion in the central region of the combustion chamber between the intake opening and the exhaust opening. Thus, even when the distance between the intake opening and the exhaust opening is not ensured, interference of the ignition and the fuel injector with components mounted in the cylinder head, such as the valve actuators, is significantly reduced or prevented. Consequently, constraints on the shape and layout of the valve actuators are significantly reduced. Therefore, the outboard motor including the internal combustion engine is provided in which the fuel injector and the ignition are disposed such that a favorable flame front is created while the air-fuel mixture distribution is homogenized and the constraints on the shape and layout of the valve actuators are significantly reduced.

In an outboard motor according to a preferred embodiment of the present invention, at least one of the fuel injector and the ignition is preferably inclined with respect to a first direction, in which the cylinder of the internal combustion engine extends, along the upward-downward direction between the pair of valve actuators in the cylinder head. Accordingly, at least one of the fuel injector and the ignition escapes in the upward-downward direction in which the valve actuating shaft extends and, thus, as compared with the case in which neither the fuel injector nor the ignition is inclined, the fuel injector and the ignition are easily spaced apart from each other while interference of the fuel injector and the ignition with the valve actuators is significantly reduced or prevented. Consequently, the fuel injector and the ignition are easily mounted in the cylinder head so as not to interfere with each other and so that constraints on the shape and layout of the valve actuators are significantly reduced.

In this case, the ignition is preferably inclined away from the fuel injector along the upward-downward direction between the pair of valve actuators in the cylinder head. Accordingly, the fuel injector and the ignition inclined away from the fuel injector are more easily mounted in the cylinder head so as not to interfere with each other and so that constraints on the shape and layout of the valve actuators are significantly reduced.

In an outboard motor according to a preferred embodiment of the present invention, the ignition portion is preferably deviated in the upward-downward direction from a center of the combustion chamber in the upward-downward direction. Accordingly, the ignition portion is deviated in the upward-downward direction from the center of the combustion chamber in the upward-downward direction and, thus, the injection portion is easily disposed near the center of the combustion chamber in the upward-downward direction. Consequently, the injection portion is disposed such that the air-fuel mixture is more homogeneously distributed from the vicinity of the center of the combustion chamber in the upward-downward direction to the entirety of the combustion chamber.

In this case, the injection portion is preferably deviated in a second direction, which is perpendicular or substantially perpendicular to the upward-downward direction, from a center of the combustion chamber in the second direction along or near a centerline that passes through the center of the combustion chamber in the upward-downward direction and extends in the second direction. Accordingly, the injection portion is deviated in the second direction from the center of the combustion chamber in the second direction and, thus, the ignition portion deviated in the upward-downward direction from the center in the upward-downward direction is easily disposed near the center of the combustion chamber in the second direction. Consequently, the injection portion is disposed such that the air-fuel mixture is more homogeneously distributed from the vicinity of the center of the combustion chamber in the upward-downward direction to the entirety of the combustion chamber, and the ignition portion is disposed such that the combustion more uniformly propagates from the vicinity of the center of the combustion chamber in the second direction. Therefore, the combustion efficiency of the internal combustion engine is further improved.

In a structure in which the injection portion is deviated in the second direction, the intake opening and the exhaust opening are preferably respectively provided on a first side and a second side in the second direction with respect to the center of the combustion chamber in the second direction, and the injection portion is preferably deviated to the first side in the second direction with respect to the center of the combustion chamber in the second direction. Accordingly, the injection portion is disposed away from the vicinity of the exhaust opening, the temperature of which is likely to be high, and occurrence of a thermal failure in the fuel injector is significantly reduced or prevented.

In an outboard motor according to a preferred embodiment of the present invention, the fuel injector preferably extends in a first direction in which the cylinder of the internal combustion engine extends between the pair of valve actuators in the cylinder head. Accordingly, interference of the fuel injector with the pair of valve actuators, etc., is further significantly reduced or prevented. Furthermore, the position of the injection portion such as the injection angle of the injection portion is easily adjusted such that the air-fuel mixture becomes homogeneous throughout the combustion chamber.

In an outboard motor according to a preferred embodiment of the present invention, the internal combustion engine preferably further includes a valve actuator lid unit that covers the pair of valve actuators, and the fuel injector is preferably inclined with respect to a first direction, in which the cylinder of the internal combustion engine extends, along a second direction, which is perpendicular or substantially perpendicular to the upward-downward direction, such that the fuel injector avoids the pair of valve actuators and the valve actuator lid unit between the pair of valve actuators in the cylinder head. Accordingly, an increase in the length of the fuel injector in the first direction in which the cylinder extends is significantly reduced or prevented while interference of the fuel injector with the pair of valve actuators and the valve actuator lid unit is significantly reduced or prevented.

In a structure in which the ignition is inclined away from the fuel injector along the upward-downward direction, the ignition preferably includes a first ignition including a first ignition portion deviated to a first side in the upward-downward direction with respect to the injection portion in the central region and that provides ignition within the combustion chamber, the first ignition being inclined away from the fuel injector toward the first side in the upward-downward direction between the pair of valve actuators in the cylinder head, and a second ignition including a second ignition portion deviated to the second side in the upward-downward direction with respect to the injection portion in the central region and that provides ignition within the combustion chamber, the second ignition being inclined away from the fuel injector toward the second side in the upward-downward direction between the pair of valve actuators in the cylinder head. Accordingly, even when a plurality of ignitions are provided, the fuel injector and the plurality of ignitions are easily mounted in the cylinder head so as not to interfere with each other. Furthermore, the plurality of ignitions are provided such that the combustion in the combustion chamber more uniformly propagates due to two-point ignition.

In an outboard motor according to a preferred embodiment of the present invention, the intake opening preferably includes a pair of intake openings provided on a first side in a second direction, which is perpendicular or substantially perpendicular to the upward-downward direction, with respect to a center of the combustion chamber in the second direction, the exhaust opening preferably includes a pair of exhaust openings provided on a second side in the second direction with respect to the center of the combustion chamber in the second direction, and the central region of the combustion chamber is preferably provided in a region surrounded by the pair of intake openings and the pair of exhaust openings. Accordingly, the injection portion and the ignition portion are disposed in the central region surrounded by the pair of intake openings and the pair of exhaust openings such that the combustion efficiency of the multi-valve internal combustion engine is further improved.

In this case, the injection portion preferably injects the fuel into the combustion chamber from between the pair of intake openings provided on the first side in the second direction with respect to the center of the combustion chamber in the second direction or from between the pair of exhaust openings provided on the second side in the second direction with respect to the center of the combustion chamber in the second direction, and the ignition portion is preferably disposed between the intake opening and the exhaust opening provided on a first side in the upward-downward direction with respect to a center of the combustion chamber in the upward-downward direction. Accordingly, in the multi-valve internal combustion engine, the injection portion is disposed such that the air-fuel mixture is more homogeneously distributed from the vicinity of the center of the combustion chamber in the upward-downward direction to the entirety of the combustion chamber, and the ignition portion is disposed such that the combustion more uniformly propagates from the vicinity of the center of the combustion chamber in the second direction. Consequently, the combustion efficiency of the multi-valve internal combustion engine is further improved.

In a structure in which the injection portion injects the fuel from between the pair of intake openings or from between the pair of exhaust openings, the injection portion preferably injects the fuel into the combustion chamber from between the pair of intake openings provided on the first side in the second direction with respect to the center of the combustion chamber in the second direction. Accordingly, in the multi-valve internal combustion engine, the injection portion is disposed away from the vicinity of the exhaust openings, the temperature of which is likely to be high, and thus occurrence of a thermal failure in the fuel injector is significantly reduced or prevented.

In an outboard motor according to a preferred embodiment of the present invention, the valve actuators are preferably direct-acting valve actuators including a plurality of cams that come into contact with cam contacts of the plurality of valves, respectively. Accordingly, it is not necessary to provide rocker arms, a mechanism that drives the rocker arms, etc. in the valve actuators as compared with the case in which the valve actuators are rocker arm-type valve actuators including rocker arms that transmit a drive force between the valve actuators and valves. Consequently, the number of components of the internal combustion engine is reduced, and an increase in the size of the internal combustion engine is significantly reduced or prevented. Unlike the case in which the distance between the intake opening and the exhaust opening is large and no power is transmitted between the valve actuators and the valves unless rocker arms are used, according to a preferred embodiment of the present invention, interference of the ignition and the fuel injector with the components mounted in the cylinder head, such as the valve actuators, is significantly reduced or prevented even when the distance between the intake opening and the exhaust opening is not ensured. Thus, the direct-acting valve actuators are preferably used.

In an outboard motor according to a preferred embodiment of the present invention, the internal combustion engine is preferably a V-type internal combustion engine. Accordingly, in the case of a V-type internal combustion engine, the injection portion of the fuel injector and the ignition portion that provides ignition within the combustion chamber are disposed in the central region of the combustion chamber such that the combustion efficiency of the V-type internal combustion engine is further improved. Furthermore, when the internal combustion engine includes a plurality of cylinders, an increase in the size of the internal combustion engine in a direction in which the cylinders are aligned is significantly reduced or prevented as compared with an in-line internal combustion engine.

In a structure in which at least one of the fuel injector and the ignition is inclined along the upward-downward direction, the internal combustion engine is preferably housed in the cowling such that a plurality of the cylinders are aligned in the upward-downward direction. Accordingly, at least one of the fuel injector and the ignition is inclined along the direction in which the plurality of cylinders disposed at intervals and likely to have empty spaces therebetween are aligned and, thus, interference of at least one of the fuel injector and the ignition with another component in the outboard motor is significantly reduced or prevented.

A marine vessel according to a preferred embodiment of the present invention includes a vessel body and an outboard motor mounted on the vessel body. The outboard motor includes an internal combustion engine, a cowling in which the internal combustion engine is housed, and a propulsion unit that converts a rotational drive force of the internal combustion engine into a thrust force. The internal combustion engine includes a cylinder head including an intake opening through which intake air is introduced into a combustion chamber of a cylinder and an exhaust opening through which exhaust gas is discharged from the combustion chamber, a plurality of valves that open and close the intake opening and the exhaust opening, a pair of valve actuators provided for the cylinder head, each including a valve actuating shaft, and that transmit a drive force to the plurality of valves, a fuel injector mounted in the cylinder head and including an injection portion that injects fuel from a central region of the combustion chamber between the intake opening and the exhaust opening into the combustion chamber, and an ignition mounted in the cylinder head and including an ignition portion deviated in an upward-downward direction, in which the valve actuating shaft extends, with respect to the injection portion in the central region and that provides ignition within the combustion chamber.

In a marine vessel according to a preferred embodiment of the present invention, the injection portion and the ignition portion that provides ignition within the combustion chamber are disposed in the central region of the combustion chamber between the intake opening and the exhaust opening in the outboard motor. Thus, similarly to the outboard motors according to preferred embodiments of the present invention described above, in the internal combustion engine of the outboard motor, the fuel injector and the ignition are disposed such that a favorable flame front is created while an air-fuel mixture distribution is homogenized and, thus, the combustion efficiency of the internal combustion engine is improved.

In a marine vessel according to a preferred embodiment of the present invention, the ignition portion is deviated in the upward-downward direction, in which the valve actuating shaft extends, with respect to the injection portion in the central region of the combustion chamber between the intake opening and the exhaust opening in the outboard motor. Thus, similarly to the outboard motors according to preferred embodiments of the present invention described above, the marine vessel including the outboard motor including the internal combustion engine is provided in which the fuel injector and the ignition are disposed such that a favorable flame front is created while the air-fuel mixture distribution is homogenized and such that constraints on the shape and layout of the valve actuators are significantly reduced.

In a marine vessel according to a preferred embodiment of the present invention, at least one of the fuel injector and the ignition is preferably inclined with respect to a first direction, in which the cylinder of the internal combustion engine extends, along the upward-downward direction between the pair of valve actuators in the cylinder head. Accordingly, at least one of the fuel injector and the ignition escapes in the upward-downward direction in which the valve actuating shaft extends and, thus, as compared with the case in which neither the fuel injector nor the ignition is inclined, the fuel injector and the ignition are easily spaced apart from each other while interference of the fuel injector and the ignition with the valve actuators is significantly reduced or prevented. Consequently, the fuel injector and the ignition are easily mounted in the cylinder head so as not to interfere with each other and so that constraints on the shape and layout of the valve actuators are significantly reduced.

In this case, the ignition is preferably inclined away from the fuel injector along the upward-downward direction between the pair of valve actuators in the cylinder head. Accordingly, the fuel injector and the ignition inclined away from the fuel injector are more easily mounted in the cylinder head so as not to interfere with each other such that constraints on the shape and layout of the valve actuators are significantly reduced.

In a marine vessel according to a preferred embodiment of the present invention, the ignition portion is preferably deviated in the upward-downward direction from a center of the combustion chamber in the upward-downward direction. Accordingly, the ignition portion is deviated in the upward-downward direction from the center of the combustion chamber in the upward-downward direction and, thus, the injection portion is easily disposed near the center of the combustion chamber in the upward-downward direction. Consequently, the injection portion is disposed such that an air-fuel mixture is more homogeneously distributed from the vicinity of the center of the combustion chamber in the upward-downward direction to the entirety of the combustion chamber.

In this case, the injection portion is preferably deviated in a second direction, which is perpendicular or substantially perpendicular to the upward-downward direction, from a center of the combustion chamber in the second direction, along or near a centerline that passes through the center of the combustion chamber in the upward-downward direction and extends in the second direction. Accordingly, the injection portion is deviated in the second direction from the center of the combustion chamber in the second direction and, thus, the ignition portion deviated in the upward-downward direction from the center in the upward-downward direction is easily disposed near the center of the combustion chamber in the second direction. Consequently, the injection portion is disposed such that the air-fuel mixture is more homogeneously distributed from the vicinity of the center of the combustion chamber in the upward-downward direction to the entirety of the combustion chamber, and the ignition portion is disposed such that the combustion more uniformly propagates from the vicinity of the center of the combustion chamber in the second direction. Therefore, the combustion efficiency of the internal combustion engine is further improved.

The above and other elements, features, steps, characteristics and advantages of preferred embodiments of the present invention will become more apparent from the following detailed description of the preferred embodiments with reference to the attached drawings.

DETAILED DESCRIPTION OF THE PREFERRED EMBODIMENTS

Preferred embodiments of the present invention are hereinafter described with reference to the drawings.

First Preferred Embodiment

The structure of an outboard motor 100 according to a first preferred embodiment of the present invention is now described with reference to FIGS. 1 and 2. In the figures, a direction X represents the forward and rearward movement direction of a marine vessel 100*a*, and a direction Y represents a right-left direction perpendicular or substantially perpendicular to the forward and rearward movement direction of the marine vessel 100*a* in a horizontal plane. A direction Z represents an upward-downward direction perpendicular or substantially perpendicular to the direction X and the direction Y (horizontal plane). In the first preferred embodiment, the outboard motor 100 mounted on a vessel body 100*b* in a tilted-down state and in which no steering is performed (a state in which a thrust force acts forward or rearward) is described.

Figure 1:
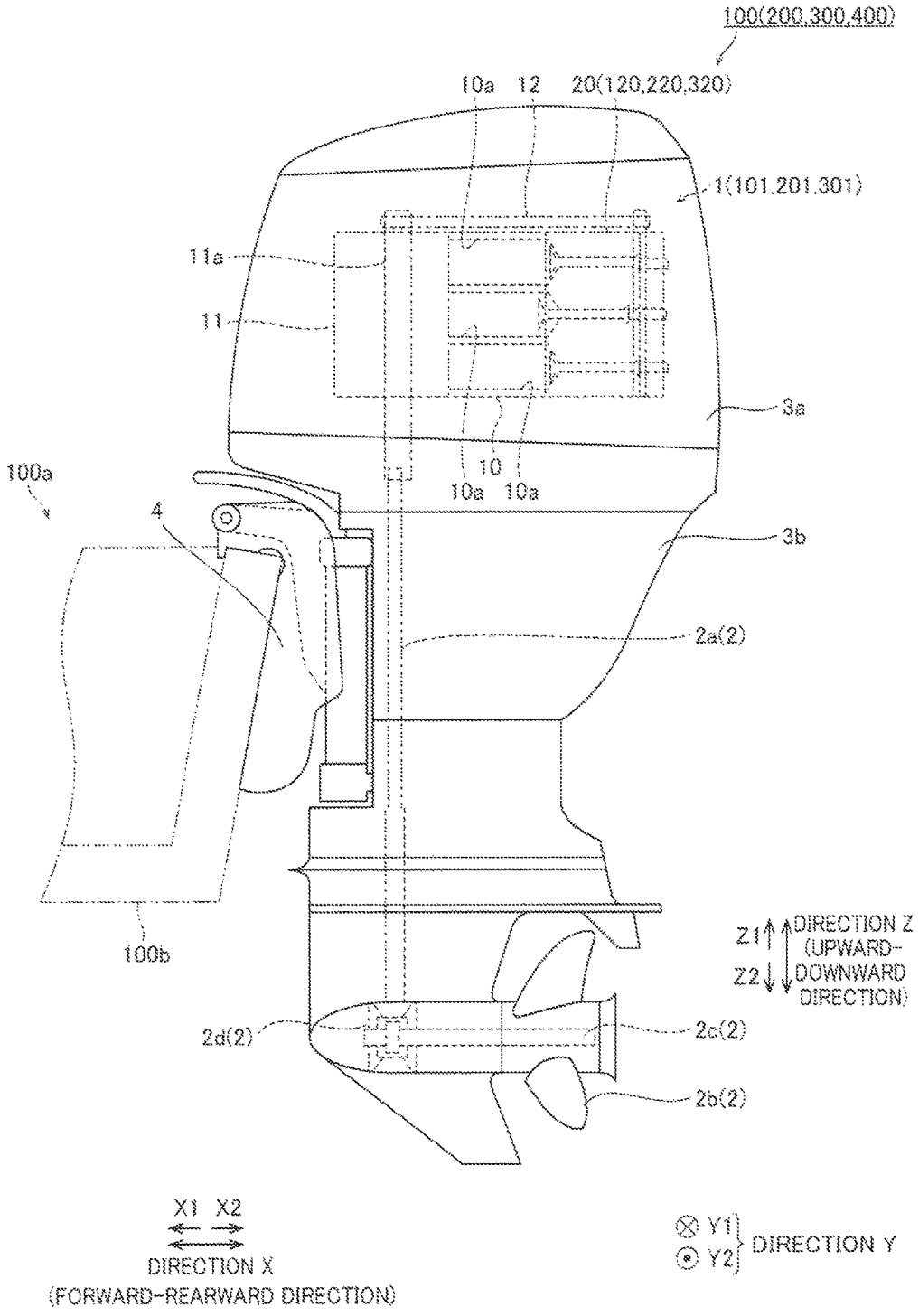
FIG. 1 is a side elevational view schematically showing an outboard motor according to a first preferred embodiment of the present invention.

As shown in FIG. 1, the outboard motor 100 according to the first preferred embodiment is mounted on the vessel body 100*b* of the marine vessel 100*a* through a bracket 4. The outboard motor 100 includes a V-type or V-shaped six-cylinder engine 1, for example, a propulsion unit 2, a cowling 3*a* in which the engine 1 is housed, and the bracket 4 that mounts the outboard motor 100 on the vessel body 100*b*. The engine 1 is an example of an "internal combustion engine".

The propulsion unit 2 converts the rotational drive force of the engine 1 into the thrust force of the marine vessel 100*a*. The propulsion unit 2 includes a drive shaft 2*a* connected to the engine 1, a propeller 2*b*, a propeller shaft 2*c* connected to the drive shaft 2*a* and the propeller 2*b*, and a switch 2*d* that switches the direction of the thrust force by switching the rotational direction of the propeller 2*b*.

The cowling 3*a* covers the engine 1 from above (direction Z1). A case 3*b* in which the drive shaft 2*a* and the switch 2*d* of the propulsion unit 2, etc. are housed is disposed below the cowling 3*a*.

The bracket 4 includes a tilt (trim) function of rotating the outboard motor 100 about an axis that extends in the right-left direction (direction Y) and a steering function of performing steering by rotating the outboard motor 100 about an axis that extends in the upward-downward direction (direction Z).

Figure 2:
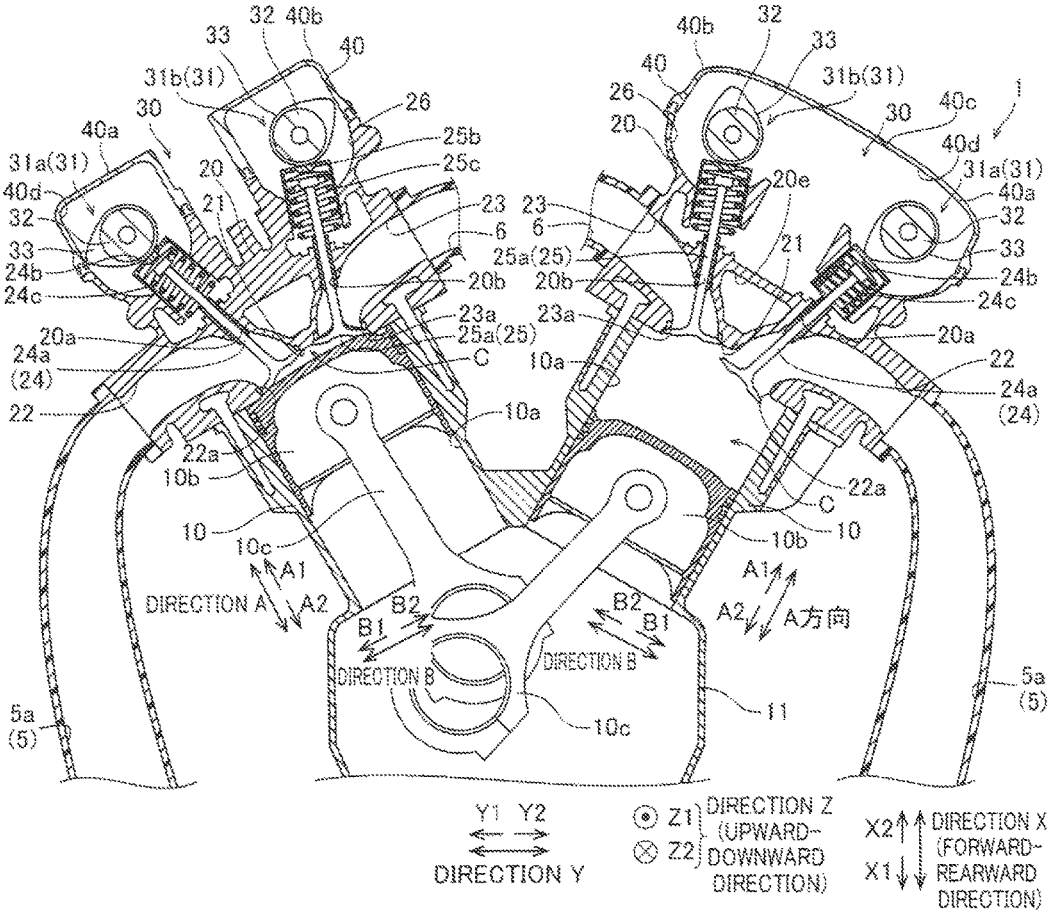
FIG. 2 is a sectional view showing the periphery of an engine of the outboard motor according to the first preferred embodiment of the present invention.

As shown in FIG. 2, the outboard motor 100 further includes intakes 5 and exhausts 6. The intakes 5 supply air taken into the cowling 3*a* to the engine 1 as intake air. The exhausts 6 discharge exhaust gas discharged from the engine 1 into water outside the outboard motor 100 through an exhaust passage (not shown) provided in the outboard motor 100. In the intakes 5 and the exhausts 6, ends of intake pipes 5*a* and exhaust pipes 6*a* are connected to the six cylinders (cylinders 10*a*) of the engine 1, respectively.

The structure of the engine 1 is now described in detail with reference to FIGS. 1 to 6.

The engine 1 is preferably a V-type or V-shaped six-cylinder four-cycle engine, for example. That is, as shown in FIG. 2, the cylinders 10*a* are disposed in a V-shape that opens rearward (direction X2) in a plan view from above (direction Z1).

The engine 1 includes a pair of cylinder blocks 10 each including three cylinders 10*a* and a crankcase 11 on which the pair of cylinder blocks 10 are mounted in a V-shape and in which a crankshaft 11*a* is disposed.

In each of the pair of cylinder blocks 10, the three cylinders 10*a* are aligned in the upward-downward direction. Inside the cylinders 10*a*, pistons 10*b* are slidably disposed along a direction A in which the cylinders 10*a* extend. The direction A in which the cylinders 10*a* provided in the cylinder block 10 on a Y1 side extend is different from the direction A in which the cylinders 10*a* provided in the cylinder block 10 on a Y2 side extend.

The pistons 10*b* are mounted on the crankshaft 11 (see FIG. 1) through connecting rods 10*c*. Consequently, in the engine 1, the sliding of the pistons 10*b* in the direction A is converted into the rotation of the crankshaft 11*a*. The direction A is an example of a "first direction".

As shown in FIG. 1, the crankshaft 11*a* extends in the upward-downward direction (direction Z) inside the crankcase 11. Although the crankshaft 11*a* is illustrated in a columnar shape in FIG. 1, actually, a crankpin, a balance weight, etc. are mounted as appropriate. The lower end (Z2-side end) of the crankshaft 11*a* is connected to the drive shaft 2*a*. Thus, the rotation of the crankshaft 11*a* is transmitted to the drive shaft 2*a* such that the rotational drive force of the engine 1 is transmitted to the propeller 2*b*.

A timing belt 12 is connected to the upper end (Z1-side end) of the crankshaft 11*a*. The timing belt 12 is disposed above (direction Z1) the cylinder blocks 10, the crankcase 11, and cylinder heads 20 described below, and extends in the horizontal plane. The timing belt 12 transmits the rotational drive force of the crankshaft 11*a* to valve actuating shafts 32 of valve actuators 31 described below.

As shown in FIG. 2, the engine 1 further includes a pair of cylinder heads 20 mounted on the pair of cylinder blocks 10, respectively, a pair of valve actuating units 30 that correspond to the pair of cylinder heads 20, respectively, and a pair of valve actuator lid units 40 that cover the valve actuators 31 of the valve actuating units 30.

The cylinder heads 20 each include three recesses 21 aligned in the upward-downward direction (direction perpendicular or substantially perpendicular to the plane of the figure). The three recesses 21 are provided at positions that face the three cylinders 10*a* of each of the cylinder blocks 10, respectively, and the three recesses 21 and the corresponding cylinders 10*a* define combustion chambers C. The three combustion chambers C are provided on the Y1 side in the engine 1, and the three combustion chambers C are provided on the Y2 side in the engine 1.

The six combustion chambers C preferably have the same or similar structure. Therefore, from now on, the structure relating to one combustion chamber C defined by one cylinder 10*a* and the corresponding recess 21 is described in detail, and the description of the structure relating to the other five combustion chambers C is omitted to avoid repetitious description.

The cylinder head 20 further includes an intake port 22 provided on a first side (B1 side) in a direction B perpendicular or substantially perpendicular to the direction A and the direction Z (upward-downward direction) and an exhaust port 23 provided on a second side (B2 side) in the direction B. The intake port 22 connects the corresponding combustion chamber C to the intake pipe 5*a*. The exhaust port 23 connects the corresponding combustion chamber C to the exhaust pipe 6*a*. Both the intake port 22 and the exhaust port 23 are branched toward the corresponding combustion chamber C. The direction B is an example of a "first direction".

Figure 3:
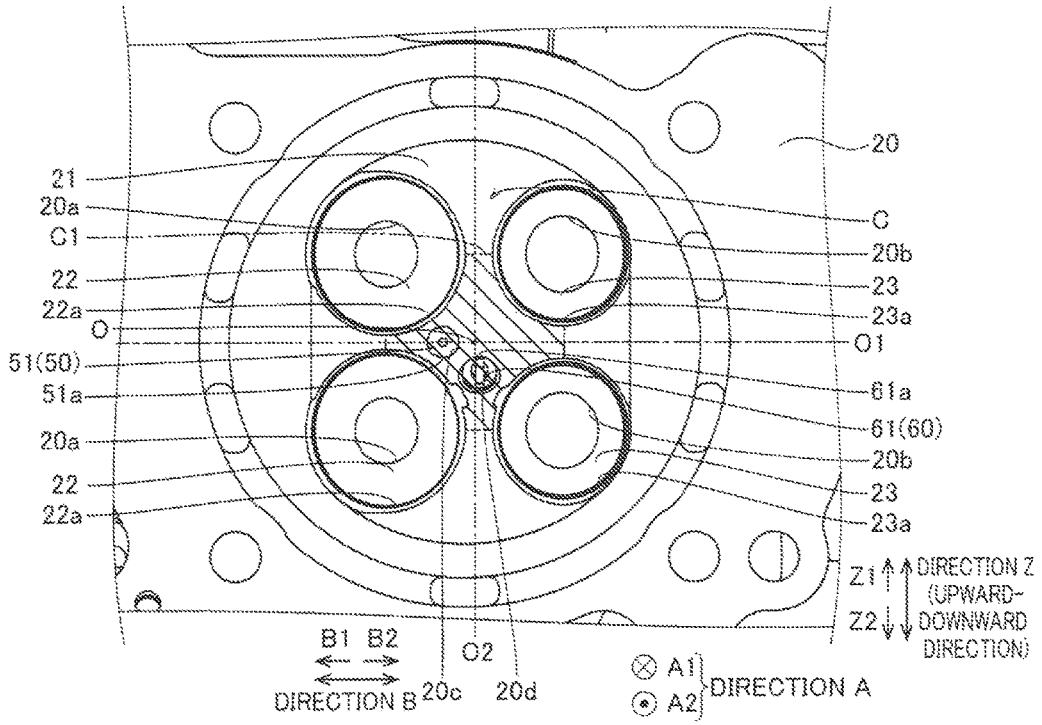
FIG. 3 is a partial bottom view of a cylinder head in the engine of the outboard motor according to the first preferred embodiment of the present invention.

As shown in FIG. 3, the intake port 22 includes a pair of intake openings 22*a* connected to (communicating with) the combustion chamber C. Similarly, the exhaust port 23 includes a pair of exhaust openings 23*a* connected to (communicating with) the combustion chamber C. Consequently, for one combustion chamber C, the pair of intake openings 22*a* and the pair of exhaust openings 23*a* are provided in the cylinder head 20.

The intake openings 22*a* introduce the intake air that has flowed through the intake pipe 5*a* and the intake port 22 into the combustion chamber C of the corresponding cylinder 10*a*. The exhaust openings 23*a* discharge the exhaust gas discharged from the combustion chamber C of the corresponding cylinder 10*a* through the exhaust port 23 and the exhaust pipe 6*a*. The temperature of the exhaust gas discharged from the combustion chamber C is higher than that of the intake air.

The pair of intake openings 22*a* are provided at a predetermined interval in the upward-downward direction on the B1 side with respect to the center (centerline O2) of the combustion chamber C in the direction B. The pair of exhaust openings 23*a* are provided at a predetermined interval in the upward-downward direction on the B2 side with respect to the centerline O2. The opening area of the intake openings 22*a* is larger than the opening area of the exhaust openings 23*a*.

As shown in FIG. 2, intake valves 24 that open and close the intake openings 22*a* and exhaust valves 25 that open and close the exhaust openings 23*a* are mounted in the cylinder head 20. Consequently, in the cylinder head 20, a pair of intake valves 24 and a pair of exhaust valves 25 are provided for one combustion chamber C. That is, the engine 1 according to the first preferred embodiment is a multi-valve type engine. The intake valves 24 and the exhaust valves 25 are examples of a "valve".

The intake valves 24 each include a valve body 24*a* that extends along a direction A1, a tappet 24*b*, and a coil spring 24*c*. An A2-side end of the valve body 24*a* spreads outward in a flange shape so as to have the same area or substantially the same area as each of the intake openings 22*a* to close the intake openings 22*a*. The tappet 24*b* slides the valve body 24*a* in the direction A in accordance with a rotating cam 33 by coming into contact with the cam 33 described below. The coil spring 24*c* generates an urging force to keep the tappet 24*b* in contact with the cam 33. The exhaust valves 25 preferably have the same or substantially the same structure as the intake valves 24. That is, the exhaust valves 25 each include a valve body 25*a*, a tappet 25*b*, and a coil spring 25*c*. The tappets 24*b* and 25*b* are examples of a "cam contact".

The intake valves 24 each pass through an insertion hole 20*a* that connects the upper surface of the cylinder head 20 to the intake port 22. The insertion hole 20*a* extends in the direction A, and is inclined in a direction B1 toward the direction A1. Thus, the intake valves 24 extend in the direction A, and are mounted in the cylinder head 20 while being inclined in the direction B1 toward the direction A1.

The exhaust valves 25 each pass through an insertion hole 20*b* that connects the upper surface of the cylinder head 20 to the exhaust port 23. The insertion hole 20*b* extends in the direction A, and is inclined in a direction B2 toward the direction A1. Thus, the exhaust valves 25 extend in the direction A, and are mounted in the cylinder head 20 while being inclined in the direction B2 toward the direction A1.

The pair of intake valves 24 are disposed at a predetermined interval in the upward-downward direction on the B1 side. The pair of exhaust valves 25 are disposed at a predetermined interval in the upward-downward direction on the B2 side. Upper portions of the pair of intake valves 24 and upper portions of the pair of exhaust valves 25 are respectively disposed in housing recesses 26 provided on the upper surface (A1-side surface) of the cylinder head 20.

The valve actuating units 30 each include a pair of valve actuators 31. Specifically, the valve actuating units 30 each include a valve actuator 31*a* that transmits a drive force to the intake valves 24 and a valve actuator 31*b* that transmits a drive force to the exhaust valves 25 as the valve actuators 31. That is, the pair of valve actuators 31 (valve actuators 31*a* and 31*b*) are provided for one cylinder head 20. The valve actuator 31*a* is disposed on the B1 side in the cylinder head 20. The valve actuator 31*b* is disposed on the B2 side in the cylinder head 20.

The valve actuators 31 each include the valve actuating shaft 32 that extends in the upward-downward direction and a plurality of cams 33 provided on the valve actuating shaft 32 at positions corresponding to the intake valves 24 (the exhaust valves 25). The cams 33 each have a so-called egg shape in a plan view. The cams 33 come into contact with the tappets 24*b* of the intake valves 24 or the tappets 25*b* of the exhaust valves 25. That is, the valve actuators 31 of the valve actuating units 30 are direct-acting valve actuators in which power is directly transmitted from the cams 33 to the intake valves 24 or the exhaust valves 25 without using rocker arms or the like.

Figure 4:
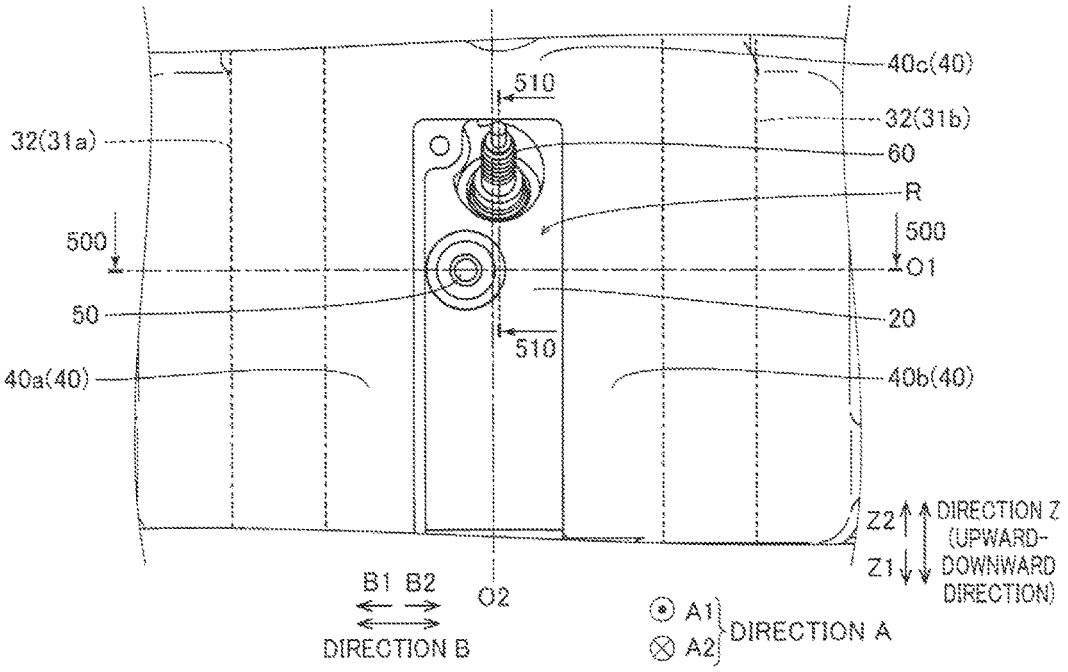
FIG. 4 is a partial top view of the engine of the outboard motor according to the first preferred embodiment of the present invention.

The valve actuator lid units 40 are mounted on A1-side portions of the valve actuators 31 so as to cover the valve actuators 31 of the valve actuating units 30. As shown in FIG. 4, the valve actuator lid units 40 each include lids 40*a* and 40*b* that cover the pair of valve actuators 31*a* and 31*b*, respectively, and a connector 40*c* that connects the lid 40*a* to the lid 40*b*. The lids 40*a* and 40*b* are provided with a gap in the direction B. Consequently, a region R in which the upper surface of the cylinder head 20 is exposed is provided at a position between the lids 40*a* and 40*b* in the direction B, which is a position between the pair of valve actuators 31.

The lids 40*a* and 40*b* include housing recesses 40*d* recessed toward an A1 side, in which the valve actuators 31*a* and 31*b* are respectively disposed.

Figure 5:
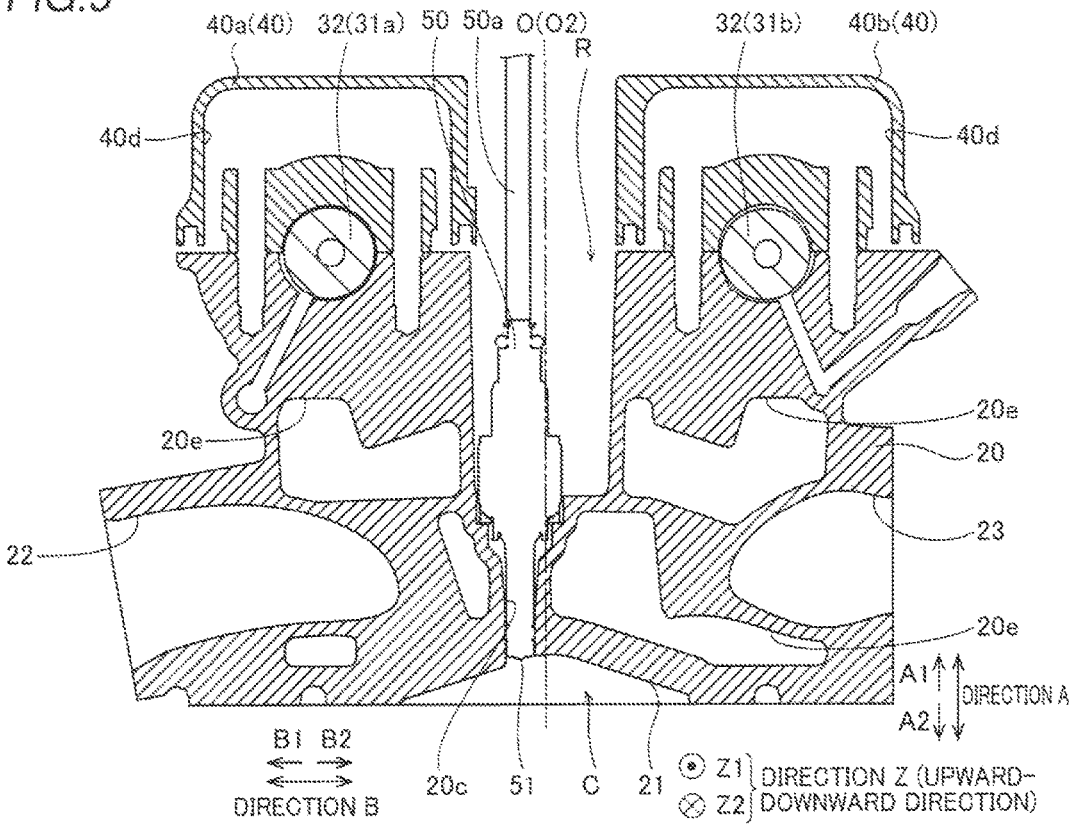
FIG. 5 is a sectional view taken along the line 500-500 in FIG. 4.
Figure 6:
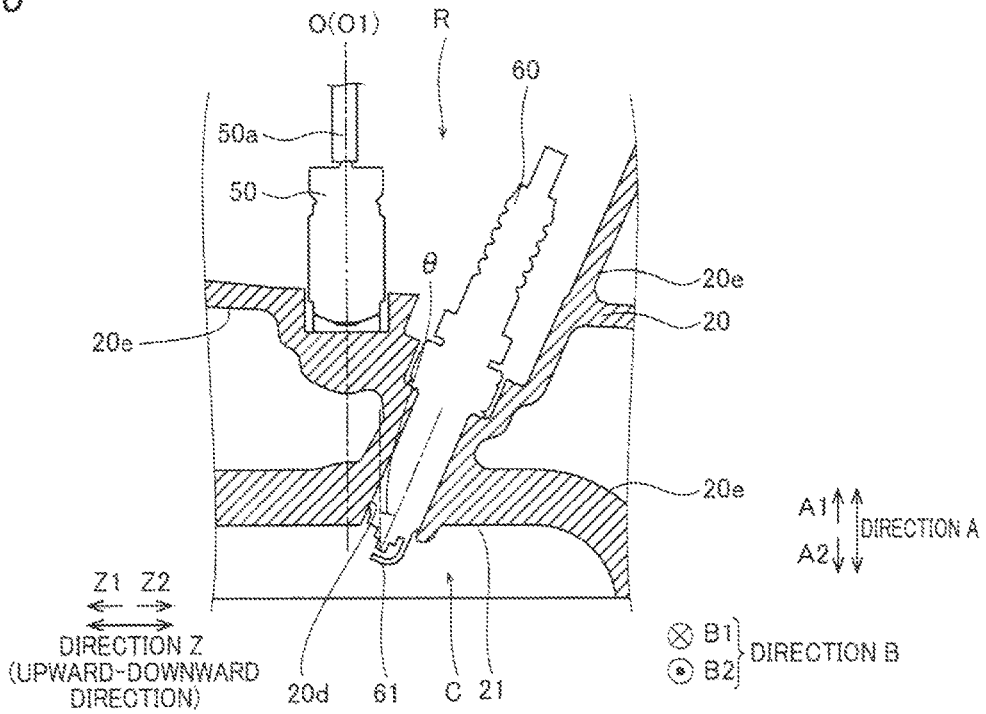
FIG. 6 is a sectional view taken along the line 510-510 in FIG. 4.

As shown in FIGS. 4 to 6, the engine 1 further includes a fuel injector 50 and an ignition 60 mounted in the cylinder head 20. The fuel injector 50 injects fuel into the combustion chamber C from an injection portion 51 at the A2-side tip. That is, the engine 1 is a direct-injection engine, and injects an appropriate amount of liquid fuel into the combustion chamber C that corresponds to the amount of intake air introduced into the combustion chamber C. The ignition 60 provides ignition within the combustion chamber C at an ignition portion 61 on an A2 side by energizing two electrodes provided on the ignition portion 61 at the A2-side tip to generate a spark. In FIGS. 4, 6, 8, 9, 11, and 12, a terminal cover or the like mounted on an A1-side portion of the ignition 60 is not shown.

Figure 7:
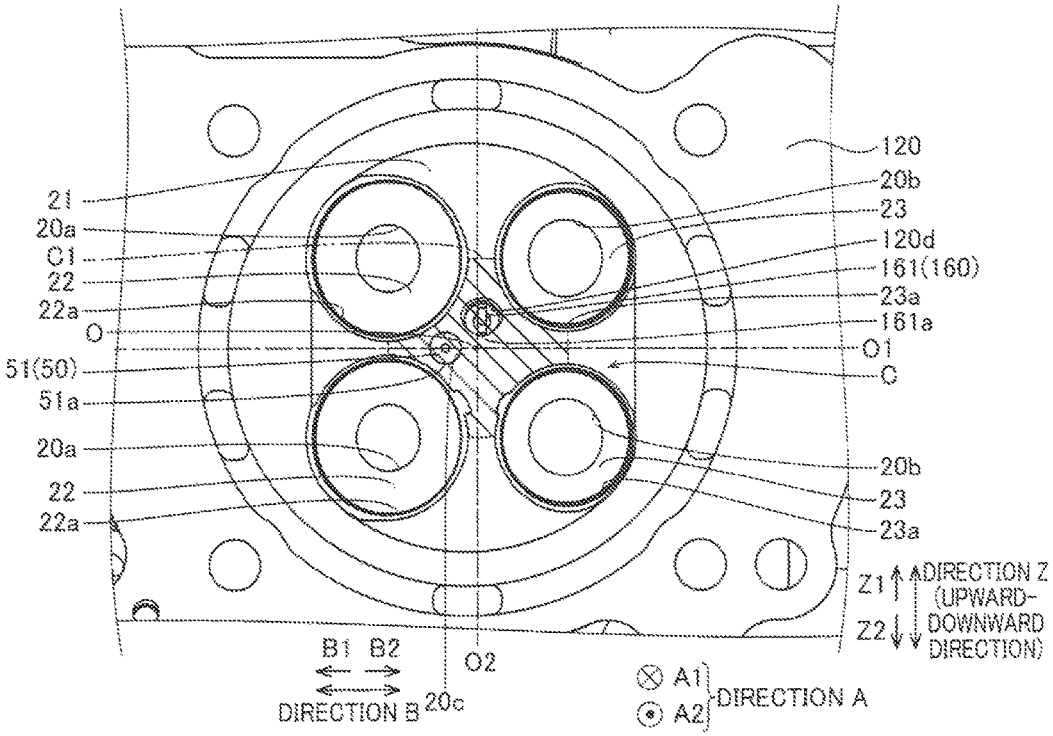
FIG. 7 is a partial bottom view of a cylinder head in an engine of an outboard motor according to a second preferred embodiment of the present invention.
Figure 10:
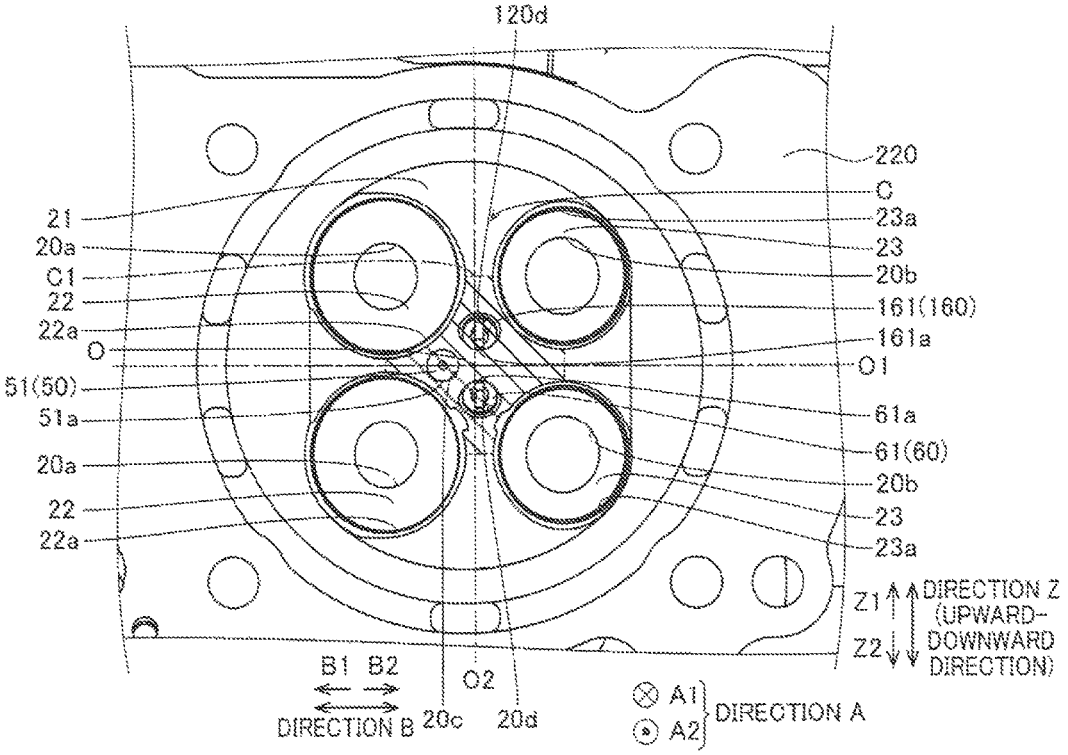
FIG. 10 is a partial bottom view of a cylinder head in an engine of an outboard motor according to a third preferred embodiment of the present invention.

According to the first preferred embodiment, both the injection portion 51 and the ignition portion 61 are exposed in a central region C1 of the combustion chamber C, as shown in FIG. 3. The central region C1 is a region surrounded by the pair of intake openings 22*a* and the pair of exhaust openings 23*a*, and includes the center O of the combustion chamber C. Specifically, the central region C1 is located on the B2 side relative to the center of the pair of intake openings 22*a* and on the B1 side relative to the center of the pair of exhaust openings 23*a* in the direction B. Furthermore, in the upward-downward direction (direction Z), the central region C1 is located on a Z2 side relative to the centers of the intake opening 22*a* and the exhaust opening 23*a* on a Z1 side and on the Z1 side relative to the centers of the intake opening 22*a* and the exhaust opening 23*a* on the Z2 side. Moreover, the central region C1 is a region not including the pair of intake openings 22*a* and the pair of exhaust openings 23*a*. In FIGS. 3, 7, and 10, the central region C1 is shown by diagonal lines.

Thus, the injection portion 51 is disposed so as to inject fuel from the central region C1 into the combustion chamber C. The ignition portion 61 is disposed in the central region C1 so as to provide ignition within the combustion chamber C. The fuel injection angle of the injection portion 51 is adjusted such that an air-fuel mixture in the combustion chamber C (cylinder 10*a*) produced by mixing the fuel injected from the injection portion 51 and the intake air that has flowed into the combustion chamber C from the intake openings 22*a* becomes homogeneous.

According to the first preferred embodiment, the injection portion 51 is deviated in the direction B from the centerline O2, which passes through the center of the combustion chamber C in the direction B and extends in the upward-downward direction through a centerline (bore centerline) O1, which passes through the center (center O) of the combustion chamber C in the upward-downward direction and extends in the direction B perpendicular or substantially perpendicular to the upward-downward direction. Specifically, the entire injection portion 51 is deviated in the direction B1, in which the pair of intake openings 22*a* are provided, from the center O (centerline O2) of the combustion chamber C. The center of the injection portion 51 is located on the centerline O1 and on the B1 side relative to the centerline O2.

According to the first preferred embodiment, the ignition portion 61 is deviated in the upward-downward direction from the center O (centerline O1) of the combustion chamber C. Specifically, the entire ignition portion 61 is deviated in a direction Z2 from the centerline O1. The ignition portion 61 is disposed on the center line O2. The center of the ignition portion 61 is located on the Z2 side relative to the centerline O1 and on the B2 side relative to the centerline O2.

A Z1-side end 61*a* of the ignition portion 61 and a Z2-side end 51*a* of the injection portion 51 are disposed at the same or substantially the same position in the upward-downward direction (direction Z). Consequently, the substantially entire ignition portion 61 is disposed on the Z2 side relative to the substantially entire injection portion 51. In the present preferred embodiment, it is only required that the center of the ignition portion 61 be deviated in the upward-downward direction relative to the center of the injection portion 51. Furthermore, the Z1-side end 61*a* of the ignition portion 61 is preferably disposed at the same or substantially the same position as the Z2-side end 51*a* of the injection portion 51, or on the Z2 side relative to the end 51*a*.

The injection portion 51 is disposed between the pair of intake openings 22*a* that are spaced apart in the direction Z. A B2-side end of the injection portion 51 and B2-side ends of the pair of intake openings 22*a* are disposed at the same or substantially the same position in the direction B.

The ignition portion 61 is disposed between the intake opening 22*a* and the exhaust opening 23*a* on the Z2 side that are spaced apart from each other in the direction B. The Z1-side end 61*a* of the ignition portion 61 and a Z1-side end of the exhaust opening 23*a* on the Z2 side are disposed at the same or substantially the same position in the direction Z.

Both the injection portion 51 and the ignition portion 61 are disposed near the center O of the combustion chamber C (central region C1).

The injection portion 51, the ignition portion 61, the pair of intake openings 22*a*, and the pair of exhaust openings 23*a* are spaced apart from each other by predetermined distances. Thus, a reduction in the mechanical strength of the cylinder head 20 in the central region C1 is significantly reduced or prevented.

As shown in FIG. 5, the fuel injector 50 passes through an insertion hole 20*c* that connects the upper surface (A1-side surface) of the cylinder head 20 in the region R between the pair of valve actuators 31 to the combustion chamber C (central region C1). The insertion hole 20*c* extends in the direction A. Thus, in the region R between the pair of valve actuators 31, the fuel injector 50 extends in the direction A in which the cylinder 10*a* extends.

A pipe 50*a* through which fuel is supplied is connected to the A1-side tip of the fuel injector 50. The fuel is supplied from a fuel tank (not shown) to the fuel injector 50 through the pipe 50*a*. The fuel injector 50 extends in the direction A in which the cylinder 10*a* extends such that interference of both the fuel injector 50 and the pipe 50*a* that extends in the direction A1 from the A1-side tip of the fuel injector 50 with the valve actuators 31 and the valve actuator lid unit 40 is significantly reduced or prevented.

As shown in FIG. 6, the ignition 60 passes through an insertion hole 20*d* that connects the upper surface of the cylinder head 20 in the region R between the pair of valve actuators 31 to the combustion chamber C (central region C1). The insertion hole 20*d* extends in the direction A, and is inclined in the direction Z2 toward the direction A1. That is, in the region R between the pair of valve actuators 31, the ignition 60 is inclined in the direction Z2 away from the fuel injector 50 with respect to the direction A. Thus, the ignition 60 is disposed so as not to interfere with the fuel injector 50 from the ignition portion 61 on the A2 side to an A1-side end thereof. Furthermore, the ignition 60 is disposed so as not to interfere with components that the outboard motor 100 includes other than the fuel injector 50.

The inclination angle θ of the ignition 60 with respect to the direction A is preferably about 45 degrees or less, and more preferably about 30 degrees or less, for example.

Consequently, according to the first preferred embodiment, in all of the six combustion chambers C, the fuel injectors 50 extend in the direction A1 on the B1 side relative to the centers O (the centerlines O2) of the combustion chambers C. The ignitions 60 are inclined in the direction Z2 with respect to the direction A on the Z2 side relative to the centers O (the centerlines O1) of the combustion chambers C.

The insertion holes 20*a* to 20*d* of the cylinder head 20 are disposed so as to avoid the intake port 22, the exhaust port 23, and a water jacket 20*e* through which cooling water used to cool the cylinder head 20 flows.

According to the first preferred embodiment of the present invention, the following advantageous effects are achieved.

According to the first preferred embodiment of the present invention, the injection portion 51 and the ignition portion 61 that provides ignition within the combustion chamber C are disposed in the central region C1 of the combustion chamber C between the intake openings 22*a* and the exhaust openings 23*a*. Thus, not only the injection of the fuel but also the ignition within the combustion chamber C is performed in the central region C1 of the combustion chamber C and, thus, the liquid fuel is appropriately injected such that the fuel is evenly distributed in the combustion chamber C. Consequently, the distribution of the air-fuel mixture produced by mixing the fuel and the intake air is homogenized in the combustion chamber C. In addition, the air-fuel mixture homogenized in the combustion chamber C is ignited in the central region C1 of the combustion chamber C. As a result, the combustion in the combustion chamber C more uniformly propagates, and a favorable flame front is created. Therefore, in the engine 1, the fuel injector 50 and the ignition 60 are disposed such that a favorable flame front is created while the air-fuel mixture distribution is homogenized and, thus, the combustion efficiency of the engine 1 is improved.

According to the first preferred embodiment of the present invention, the ignition portion 61 is deviated in the upward-downward direction in which the valve actuating shaft 32 extends with respect to the injection portion 51 in the central region C1 of the combustion chamber C between the intake openings 22*a* and the exhaust openings 23*a*. Thus, even when a distance between the intake openings 22*a* and the exhaust openings 23*a* that are spaced apart from each other in the direction B perpendicular or substantially perpendicular to the upward-downward direction is not ensured, interference of the ignition 60 and the fuel injector 50 with components mounted in the cylinder head 20, such as the valve actuators 31, is significantly reduced or prevented. Consequently, constraints on the shape and layout of the valve actuators 31 are significantly reduced. Therefore, the outboard motor 100 including the engine 1 is provided in which the fuel injectors 50 and the ignitions 60 are disposed such that favorable flame fronts are created while the air-fuel mixture distributions are homogenized such that constraints on the shape and layout of the valve actuators 31 are significantly reduced.

According to the first preferred embodiment of the present invention, the degree of freedom in designing the cylinder head 20 is increased and, thus, the intake port 22, the intake openings 22*a*, the exhaust port 23, the exhaust openings 23*a*, etc. are ensured.

According to the first preferred embodiment of the present invention, the ignition 60 is inclined along the upward-downward direction between the pair of valve actuators 31 in the cylinder head 20. Thus, the ignition 60 escapes in the upward-downward direction in which the valve actuating shaft 32 extends from the central region C1 of the combustion chamber C. Thus, as compared with the case in which neither the fuel injector nor the ignition is inclined along the upward-downward direction, the fuel injector 50 and the ignition 60 are easily spaced apart from each other while interference of the fuel injector 50 and the ignition 60 with the valve actuators 31 is significantly reduced or prevented. Consequently, the fuel injector 50 and the ignition 60 are easily mounted in the cylinder head 20 so as not to interfere with each other such that constraints on the shape and layout of the valve actuators 31 are significantly reduced.

According to the first preferred embodiment of the present invention, the ignition 60 is inclined in the direction Z2 away from the fuel injector 50 with respect to the direction A along the upward-downward direction between the pair of valve actuators 31 in the cylinder head 20. Thus, the fuel injector 50 and the ignition 60 inclined away from the fuel injector 50 are more easily mounted in the cylinder head 20 so as not to interfere with each other such that constraints on the shape and layout of the valve actuators 31 are significantly reduced.

According to the first preferred embodiment of the present invention, the ignition 60 is inclined and the fuel injector 50 is not inclined such that the ignition 60 is more easily mounted in an inclined state in the cylinder head 20 as compared with the case in which the fuel injector 50 that needs to adjust its fuel injection direction is inclined.

According to the first preferred embodiment of the present invention, the ignition portion 61 is deviated in the upward-downward direction (direction Z2) from the center O (centerline O1) of the combustion chamber C in the upward-downward direction. Thus, the ignition portion 61 is deviated in the upward-downward direction from the centerline O1 and, thus, the injection portion 51 is easily disposed near the centerline O1 of the combustion chamber C. Consequently, the injection portion 51 is disposed such that the air-fuel mixture is more homogeneously distributed from the vicinity of the centerline O1 of the combustion chamber C to the entirety of the combustion chamber C.

According to the first preferred embodiment of the present invention, the injection portion 51 is deviated in the direction B (direction B1) from the center (centerline O2) of the combustion chamber C in the direction B on the centerline O2 that passes through the center O of the combustion chamber C in the upward-downward direction and extends in the direction B perpendicular or substantially perpendicular to the upward-downward direction. Thus, the injection portion 51 is deviated in the direction B from the centerline O2 of the combustion chamber C. Thus, the ignition portion 61 deviated in the upward-downward direction from the centerline O1 is easily disposed near the centerline O2 of the combustion chamber C. Consequently, the injection portion 51 is disposed such that the air-fuel mixture is more homogeneously distributed from the vicinity of the centerline O1 of the combustion chamber C to the entirety of the combustion chamber C, and the ignition portion 61 is disposed such that the combustion more uniformly propagates from the vicinity of the centerline O2 of the combustion chamber C. Therefore, the combustion efficiency of the engine 1 is further improved.

According to the first preferred embodiment of the present invention, the intake openings 22*a* and the exhaust openings 23*a* are provided on a first side (B1 side) and a second side (B2 side) in the direction B with respect to the center (centerline O2) of the combustion chamber C in the direction B, respectively. The injection portion 51 is deviated in the direction B1 with respect to the centerline O2. Thus, the injection portion 51 is disposed away from the vicinity of the exhaust openings 23*a*, the temperature of which is likely to be high. Thus, occurrence of a thermal failure in the fuel injector 50 is significantly reduced or prevented.

According to the first preferred embodiment of the present invention, the fuel injector 50 extends in the direction A in which the cylinders (cylinders 10*a*) of the engine 1 extend between the pair of valve actuators 31 in the cylinder head 20. Thus, interference of the fuel injector 50 with the pair of valve actuators 31, etc., is further significantly reduced or prevented. Furthermore, the position of the injection portion 51 such as the injection angle of the injection portion 51 is easily adjusted such that the air-fuel mixture becomes homogeneous throughout the combustion chamber C.

According to the first preferred embodiment of the present invention, the pair of intake openings 22*a* are provided on the B1 side with respect to the center (centerline O2) of the combustion chamber C in the direction B perpendicular or substantially perpendicular to the upward-downward direction, and the pair of exhaust openings 23*a* are provided on the B2 side with respect to the centerline O2. Furthermore, the central region C1 of the combustion chamber C is provided in the region surrounded by the pair of intake openings 22*a* and the pair of exhaust openings 23*a*. Thus, the injection portion 51 and the ignition portion 61 are disposed in the central region C1 surrounded by the pair of intake openings 22*a* and the pair of exhaust openings 23*a* such that the combustion efficiency of the multi-valve engine 1 is further improved.

According to the first preferred embodiment of the present invention, the injection portion 51 injects the fuel into the combustion chamber C from between the pair of intake openings 22*a* provided on the B1 side with respect to the center (centerline O2) of the combustion chamber C in the direction B. The ignition portion 61 is disposed between the intake opening 22*a* and the exhaust opening 23*a* provided on the Z2 side in the upward-downward direction with respect to the center (centerline O1) of the combustion chamber C in the upward-downward direction. Thus, in the multi-valve engine 1, the injection portion 51 is disposed such that the fuel is more evenly distributed from the vicinity of the centerline O1 of the combustion chamber C to the entirety of the combustion chamber C, and the ignition portion 61 is disposed such that the combustion more uniformly propagates from the vicinity of the centerline O2 of the combustion chamber C. Consequently, the combustion efficiency of the multi-valve engine 1 is further improved.

According to the first preferred embodiment of the present invention, the injection portion 51 injects the fuel into the combustion chamber C from between the pair of intake openings 22*a* provided on the B1 side with respect to the center (centerline O2) of the combustion chamber C in the direction B. Thus, in the multi-valve engine 1, the injection portion 51 is disposed away from the vicinity of the exhaust openings 23*a*, the temperature of which is likely to be high. Thus, occurrence of a thermal failure in the fuel injector 50 is significantly reduced or prevented.

According to the first preferred embodiment of the present invention, the valve actuators 31 are direct-acting valve actuators including the plurality of cams 33 that come into contact with the tappets 24*b* of a plurality of intake valves 24 or the tappets 25*b* of a plurality of exhaust valves 25, respectively. Thus, it is not necessary to provide rocker arms, a mechanism that drives the rocker arms, etc. in the valve actuators 31 as compared with the case in which the valve actuators are rocker arm-type valve actuators including rocker arms that transmit a drive force between the valve actuators and valves. Consequently, the number of components in the engine 1 is reduced, and an increase in the size of the engine 1 is significantly reduced or prevented. In addition, interference of the ignition 60 and the fuel injector 50 with components mounted in the cylinder head 20, such as the valve actuators 31, is significantly reduced or prevented. Thus, even when the distance between the intake openings 22*a* and the exhaust openings 23*a* that are spaced apart from each other in the direction B perpendicular or substantially perpendicular to the upward-downward direction is not ensured, it is possible to use direct-acting valve actuators 31.

According to the first preferred embodiment of the present invention, when the engine 1 is a V-type engine, the injection portion 51 of the fuel injector 50 and the ignition portion 61 that provides ignition within the combustion chamber C are disposed in the central region C1 of the combustion chamber C such that the combustion efficiency of the V-type engine 1 is further improved. Furthermore, when the engine 1 includes a plurality of cylinders (cylinders 10*a*), an increase in the size of the engine 1 in the upward-downward direction in which the cylinders 10*a* are aligned is significantly reduced or prevented as compared with an in-line engine 1.

According to the first preferred embodiment of the present invention, the engine 1 is housed in the cowling 3*a* in which the plurality of cylinders (cylinders 10*a*) are aligned in the upward-downward direction. Thus, the ignition 60 is inclined along the upward-downward direction in which the plurality of cylinders 10*a* disposed at intervals and likely to have empty spaces therebetween are aligned. Thus, interference of the ignition 60 with another component in the outboard motor 100 is significantly reduced or prevented.

According to the first preferred embodiment of the present invention, the ignition 60 is inclined in the direction Z2 on the Z2 side (side opposite to the timing belt 12) in the cylinder head 20. Thus, in the combustion chamber C on the side (Z2 side) opposite to the timing belt 12 of the engine 1, the ignition 60 is inclined toward a clearance between the engine 1 and another component disposed in the outboard motor 100. Consequently, interference of the ignition 60 with another component in the outboard motor 100 is significantly reduced or prevented.

Second Preferred Embodiment

The structure of an engine 101 of an outboard motor 200 according to a second preferred embodiment of the present invention is now described with reference to FIGS. 1 and 7 to 9. In the second preferred embodiment, ignition portions 161 are provided on a Z1 side unlike the first preferred embodiment in which the ignition portions 61 are provided on the Z2 side. The engine 101 is an example of an "internal combustion engine".

As shown in FIG. 7, the engine 101 includes a pair of cylinder heads 120 each including three recesses 21 in which combustion chambers C are provided. The six combustion chambers C preferably have the same or similar structure as in the first preferred embodiment. Therefore, from now on, the structure relating to one combustion chamber C is described in detail, and the description of the structure relating to the other five combustion chambers C is omitted to avoid repetitious description.

The engine 101 further includes a fuel injector 50 and an ignition 160 mounted in the cylinder head 120.

According to the second preferred embodiment, both an injection portion 51 and the ignition portion 161 are exposed in a central region C1 of the combustion chamber C. The ignition portion 161 is deviated in an upward-downward direction from the center O (centerline O1) of the combustion chamber C. Specifically, the entire ignition portion 161 is deviated in a direction Z1 from the centerline O1. The ignition portion 161 is disposed on a centerline O2. The center of the ignition portion 161 is located on the Z1 side relative to the centerline O1 and on a B2 side relative to the centerline O2. A Z2-side end 161*a* of the ignition portion 161 and a Z2-side end 51*a* of the injection portion 51 are disposed at the same or substantially the same position in the upward-downward direction (direction Z). Consequently, the substantially entire ignition portion 161 is disposed on the Z1 side relative to the substantially entire injection portion 51.

The ignition portion 161 is disposed between an intake opening 22*a* and an exhaust opening 23*a* on the Z1 side that are spaced apart from each other in a direction B. The Z2-side end 161*a* of the ignition portion 161 and Z2-side ends of the intake opening 22*a* and the exhaust opening 23*a* on the Z1 side are disposed at the same or substantially the same position in the direction Z.

Figure 8:
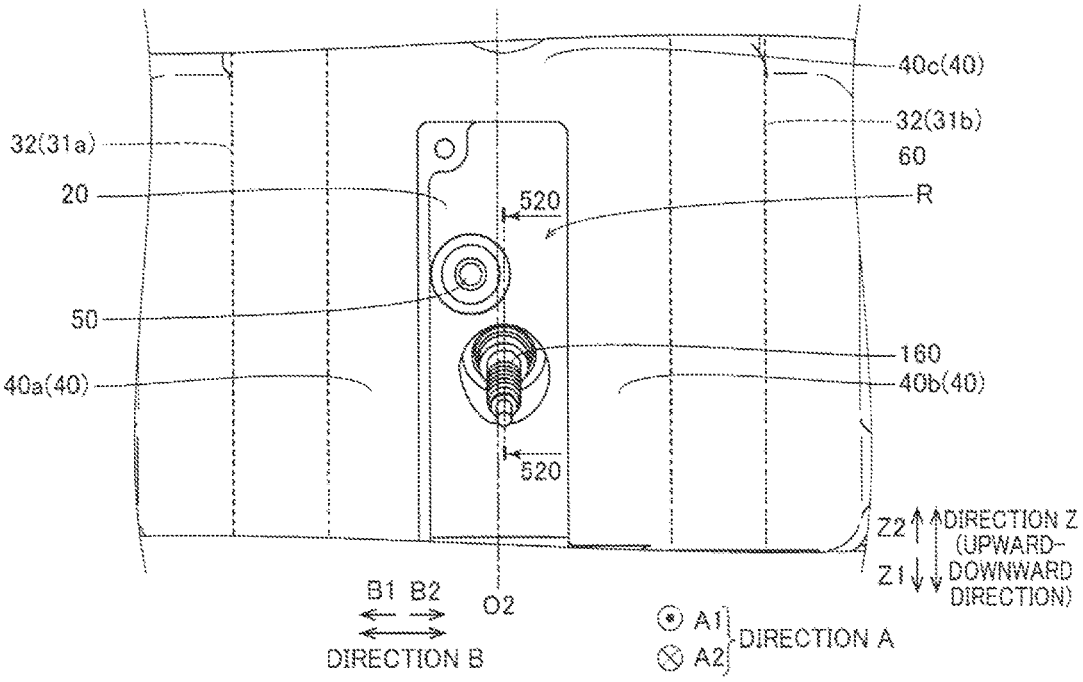
FIG. 8 is a partial top view of the engine of the outboard motor according to the second preferred embodiment of the present invention.
Figure 9:
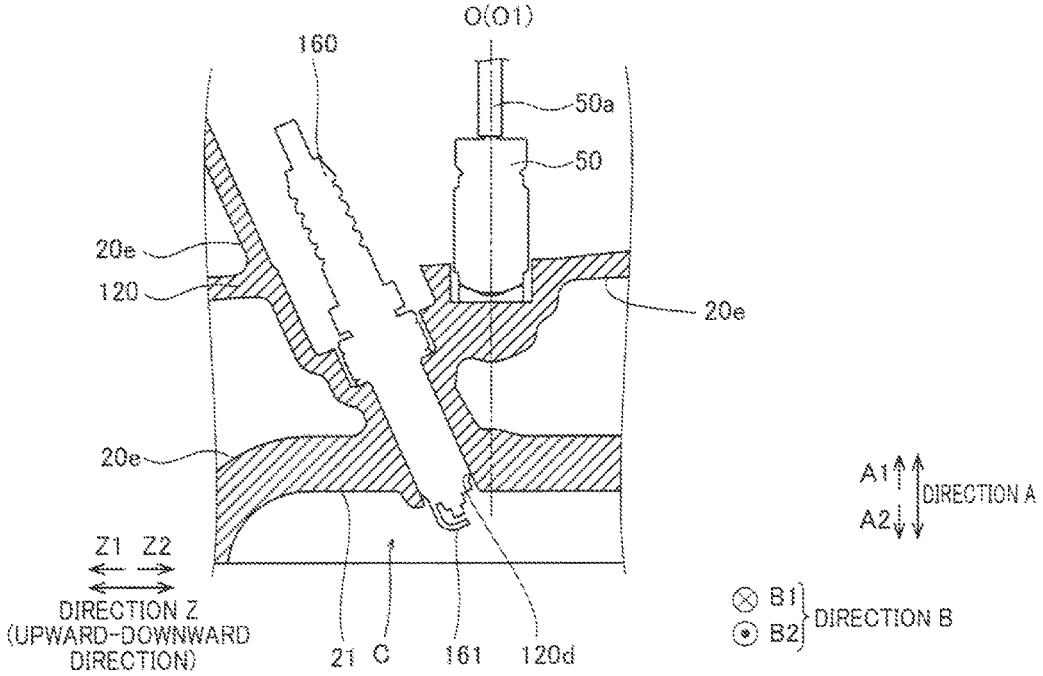
FIG. 9 is a sectional view taken along the line 520-520 in FIG. 8.

As shown in FIGS. 8 and 9, the ignition 160 passes through an insertion hole 120*d* that connects the upper surface (A1-side surface) of the cylinder head 120 to the combustion chamber C (the central region C1). The insertion hole 120*d* extends in a direction A and is inclined in the direction Z1 toward a direction A1. That is, the ignition 160 is inclined in the direction Z1 away from the fuel injector 50 with respect to the direction A in a region R between a pair of valve actuators 31. Thus, the ignition 160 is disposed so as not to interfere with the fuel injector 50 from the ignition portion 161 on an A2 side to the A1-side end thereof. Furthermore, the ignition 160 is disposed so as not to interfere with components that the outboard motor 200 includes other than the fuel injector 50.

Consequently, according to the second preferred embodiment, in all of the six combustion chambers C, the ignitions 160 are inclined in the direction Z1 with respect to the direction A on the Z1 side relative to the centers O (the centerlines O1) of the combustion chambers C. The remaining structures of the second preferred embodiment are preferably the same or similar to those of the first preferred embodiment.

According to the second preferred embodiment of the present invention, the following advantageous effects are achieved.

According to the second preferred embodiment of the present invention, the injection portion 51 and the ignition portion 161 that provides ignition within the combustion chamber C are disposed in the central region C1 of the combustion chamber C. Furthermore, the ignition portion 161 is deviated in the upward-downward direction in which a valve actuating shaft 32 extends with respect to the injection portion 51 in the central region C1 of the combustion chamber C between intake openings 22*a* and exhaust openings 23*a*. Thus, similarly to the first preferred embodiment, the outboard motor 200 including the engine 101 is provided in which the fuel injectors 50 and the ignitions 160 are disposed such that favorable flame fronts are created while air-fuel mixture distributions are homogenized and such that constraints on the shape and layout of the valve actuators 31 are significantly reduced.

According to the second preferred embodiment of the present invention, the ignition 160 is inclined in the direction Z1 on the Z1 side (side closer to a timing belt 12) in the cylinder head 120. Thus, in the combustion chamber C on the side (Z1 side) closer to the timing belt 12 of the engine 101, the ignition 160 is inclined toward a clearance between the engine 101 and the timing belt 12. Consequently, interference of the ignition 160 with another component in the outboard motor 200 is significantly reduced or prevented. The remaining advantageous effects of the second preferred embodiment are the same or similar to those of the first preferred embodiment.

Third Preferred Embodiment

Figure 11:
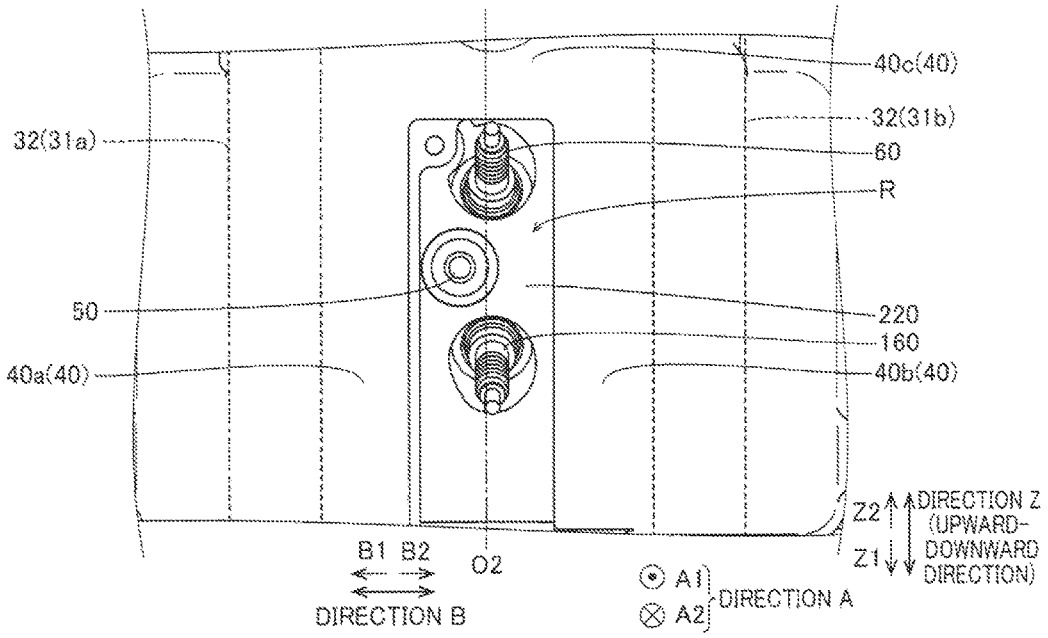
FIG. 11 is a partial top view of the engine of the outboard motor according to the third preferred embodiment of the present invention.

The structure of an engine 201 of an outboard motor 300 according to a third preferred embodiment of the present invention is now described with reference to FIGS. 1, 10, and 11. In the third preferred embodiment, the structure of the first preferred embodiment in which the ignition portions 61 are provided on the Z2 side and the structure of the second preferred embodiment in which the ignition portions 161 are provided on the Z1 side are combined. The engine 201 is an example of an "internal combustion engine".

As shown in FIG. 10, the engine 201 includes a pair of cylinder heads 220 each including three recesses 21 in which combustion chambers C are provided. The six combustion chambers C preferably have the same or similar structure as in the first preferred embodiment. Therefore, from now on, the structure relating to one combustion chamber C is described in detail, and the description of the structure relating to the other five combustion chambers C is omitted to avoid repetitious description.

The engine 201 further includes a fuel injector 50 and ignitions 60 and 160 mounted in the cylinder head 220. That is, according to the third preferred embodiment, a pair of ignitions 60 and 160 are provided for one combustion chamber C. The ignitions 60 and 160 are examples of a "first ignition" and a "second ignition", respectively.

According to the third preferred embodiment, all of an injection portion 51, an ignition portion 61 of the ignition 60, and an ignition portion 161 of the ignition 160 are exposed in a central region C1 of the combustion chamber C. The ignition portions 61 and 161 are deviated in an upward-downward direction from the center O of the combustion chamber C. The entire ignition portion 61 and the entire ignition portion 161 are deviated in a direction Z2 and a direction Z1 from the center O (centerline O1) of the combustion chamber C, respectively. The ignition portions 61 and 161 are disposed on a centerline O2. The center of the ignition portion 61 and the center of the ignition portion 161 are located on a Z2 side and a Z1 side relative to the centerline O1, respectively, and are located on a B2 side relative to the centerline O2. The substantially entire ignition portion 61 and the substantially entire ignition portion 161 are disposed on the Z2 side and the Z1 side, respectively, relative to the substantially entire injection portion 51. The ignition portions 61 and 161 are examples of a "first ignition portion" and a "second ignition portion", respectively.

The ignitions 60 and 160 are inclined in the directions Z2 and Z1 away from the fuel injector 50 with respect to the direction A, respectively, in a region R between a pair of valve actuators 31. Thus, the ignition 60 is disposed so as not to interfere with the fuel injector 50 etc. from the ignition portion 61 on an A2 side to an A1-side end thereof. The ignition 160 is disposed so as not to interfere with the fuel injector 50 etc. from the ignition portion 161 on the A2 side to an A1-side end thereof.

Consequently, according to the third preferred embodiment, in all of the six combustion chambers C, the ignitions 60 are inclined in the direction Z2 with respect to the direction A on the Z2 side relative to the centers O (the centerlines O1) of the combustion chambers C. The ignitions 160 are inclined in the direction Z1 with respect to the direction A on the Z2 side relative to the centerlines O1. The remaining structures of the third preferred embodiment are preferably the same or similar to those of the first preferred embodiment and the second preferred embodiment.

According to the third preferred embodiment of the present invention, the following advantageous effects are achieved.

According to the third preferred embodiment of the present invention, the injection portion 51 and the ignition portions 61 and 161 that provide ignition within the combustion chamber C are disposed in the central region C1 of the combustion chamber C. Furthermore, the ignition portions 61 and 161 are deviated in the upward-downward direction in which a valve actuating shaft 32 extends with respect to the injection portion 51 in the central region C1 of the combustion chamber C between intake openings 22*a* and exhaust openings 23*a*. Thus, similarly to the first preferred embodiment, the outboard motor 300 including the engine 201 is provided in which the fuel injectors 50 and the ignitions 60 and 160 are disposed such that favorable flame fronts are created while air-fuel mixture distributions are homogenized and such that constraints on the shape and layout of the valve actuators 31 are significantly reduced.

According to the third preferred embodiment of the present invention, the outboard motor 300 includes the ignition 60 including the ignition portion 61 deviated in the direction Z2 in the upward-downward direction with respect to the injection portion 51 in the central region C1 and that provides ignition within the combustion chamber C, and inclined in the direction Z2 away from the fuel injector 50 toward the direction Z2 in the upward-downward direction between the pair of valve actuators 31 in the cylinder head 220. The outboard motor 300 further includes the ignition 160 including the ignition portion 161 deviated in the direction Z1 in the upward-downward direction with respect to the injection portion 51 in the central region C1 and that provides ignition within the combustion chamber C, and inclined in the direction Z1 away from the fuel injector 50 toward the direction Z1 in the upward-downward direction between the pair of valve actuators 31 in the cylinder head 220. Thus, even when a plurality (pair) of ignitions are provided, the fuel injector 50 and the plurality of ignitions 60 and 160 are easily mounted in the cylinder head 220 so as not to interfere with each other. Furthermore, the plurality of ignitions 60 and 160 are provided such that combustion in the combustion chamber C more uniformly propagates due to two-point ignition. The remaining advantageous effects of the third preferred embodiment are preferably the same or similar to those of the first preferred embodiment and the second preferred embodiment.

Fourth Preferred Embodiment

The structure of an engine 301 of an outboard motor 400 according to a fourth preferred embodiment of the present invention is now described with reference to FIGS. 1, 3, and 12. In the fourth preferred embodiment, fuel injectors 350 are inclined unlike the fuel injectors 50 according to the first preferred embodiment. The engine 301 is an example of an "internal combustion engine".

Figure 12:
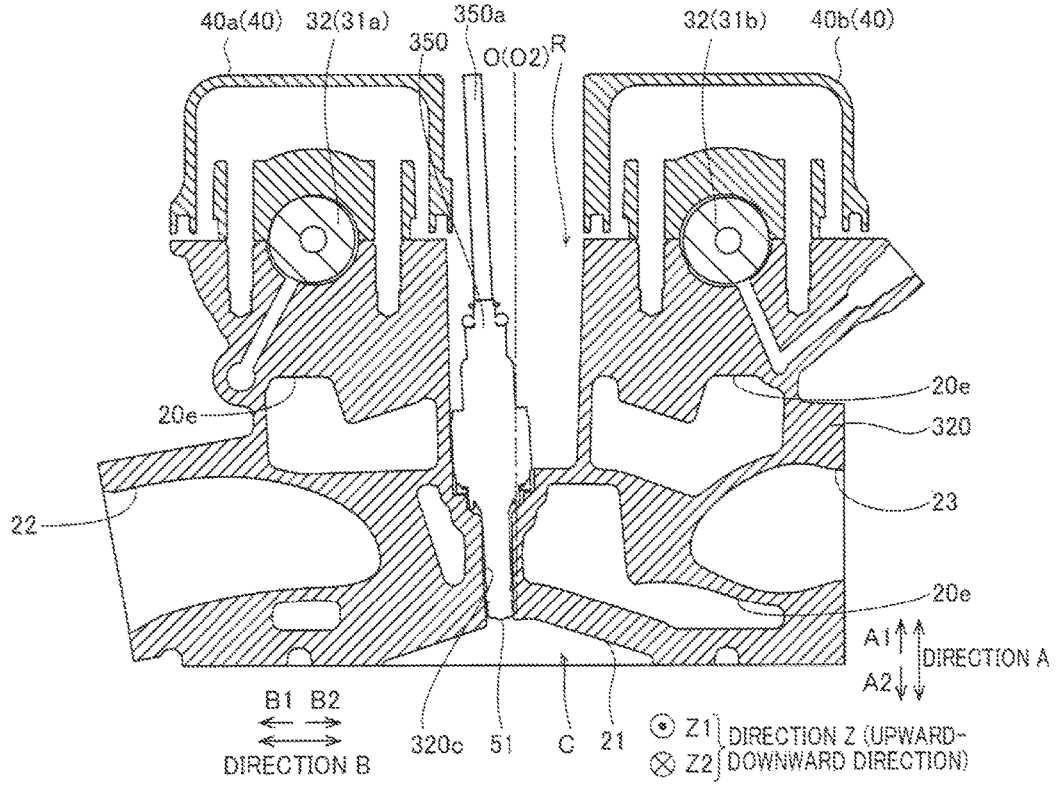
FIG. 12 is a sectional view of a cylinder head in an engine of an outboard motor according to a fourth preferred embodiment of the present invention.

As shown in FIG. 12, the engine 301 includes a pair of cylinder heads 320 each including three recesses 21 in which combustion chambers C are provided. The six combustion chambers C preferably have the same or similar structure as in the first preferred embodiment. Therefore, from now on, the structure relating to one combustion chamber C is described in detail, and the description of the structure relating to the other five combustion chambers C is omitted to avoid repetitious description.

The engine 301 further includes the fuel injector 350 and an ignition 60 (see FIG. 3) mounted in the cylinder head 320. Both an injection portion 51 of the fuel injector 350 and an ignition portion 61 (see FIG. 3) are exposed in a central region C1 (see FIG. 3) of the combustion chamber C.

According to the fourth preferred embodiment, the fuel injector 350 passes through an insertion hole 320*c* that connects the upper surface (A1-side surface) of the cylinder head 320 in a region R between a pair of valve actuators 31 to the combustion chamber C (central region C1). The insertion hole 320*c* extends in a direction A and is inclined in a direction B1 toward a direction A1. That is, the fuel injector 350 is inclined in the direction B1 on a side closer to an intake port 22 with respect to the direction A in the region R between the pair of valve actuators 31.

The fuel injector 350 is disposed such that both the fuel injector 350 and a pipe 350*a* that extends in the direction A1 from the A1-side tip of the fuel injector 350 avoid the valve actuators 31 and a valve actuator lid unit 40. The remaining structures of the fourth preferred embodiment are preferably the same or similar to those of the first preferred embodiment.

According to the fourth preferred embodiment of the present invention, the following advantageous effects are achieved.

According to the fourth preferred embodiment of the present invention, the injection portion 51 and the ignition portion 61 that provides ignition within the combustion chamber C are disposed in the central region C1 of the combustion chamber C. Furthermore, the ignition portion 61 is deviated in an upward-downward direction in which a valve actuating shaft 32 extends with respect to the injection portion 51 in the central region C1 of the combustion chamber C between intake openings 22*a* and exhaust openings 23*a*. Thus, similarly to the first preferred embodiment, the outboard motor 400 including the engine 301 is provided in which the fuel injectors 350 and the ignitions 60 are disposed such that favorable flame fronts are created while air-fuel mixture distributions are homogenized and such that constraints on the shape and layout of the valve actuators 31 are significantly reduced.

According to the fourth preferred embodiment of the present invention, the fuel injector 350 is inclined with respect to the direction A in which a cylinder 10*a* extends along the direction B perpendicular or substantially perpendicular to the upward-downward direction such that the fuel injector 350 avoids the pair of valve actuators 31 and the valve actuator lid unit 40 in the region R between the pair of valve actuators 31 of the cylinder head 320. Thus, an increase in the length of the fuel injector 350 in the direction A is significantly reduced or prevented while interference of the fuel injector 350 with the pair of valve actuators 31 and the valve actuator lid unit 40 is significantly reduced or prevented. The remaining advantageous effects of the fourth preferred embodiment are preferably the same or similar to those of the first preferred embodiment.

The preferred embodiments of the present invention described above are illustrative in all points and not restrictive. The extent of the present invention is not defined by the above description of the preferred embodiments but by the scope of the claims, and all modifications within the meaning and range equivalent to the scope of the claims are further included.

For example, while the engine 1, 101, 201, or 301 (internal combustion engine) is preferably a V-type engine including six cylinders (cylinders 10*a*) in each of the first, second, third, and fourth preferred embodiments described above, the present invention is not restricted to this. The internal combustion engine may alternatively include one or more and five or less cylinders or may alternatively include seven or more cylinders. The internal combustion engine may alternatively be an in-line engine in which a plurality of cylinders are disposed in series.

Furthermore, the internal combustion engine may alternatively be structured by appropriately combining the combustion chamber C according to the first preferred embodiment, in which the ignition 60 including the ignition portion 61 provided on the Z2 side and inclined in the direction Z2 is provided, the combustion chamber C according to the second preferred embodiment, in which the ignition 160 including the ignition portion 161 provided on the Z1 side and inclined in the direction Z1 is provided, and the combustion chamber C according to the third preferred embodiment, in which both the ignition 60 and the ignition 160 are provided. In addition, instead of the non-inclined fuel injector 50 according to the second or third preferred embodiment, the structure of the inclined fuel injector 350 according to the fourth preferred embodiment may alternatively be applied. That is, in the structure of the second or third preferred embodiment, the fuel injector may be inclined.

Furthermore, in each of the first to fourth preferred embodiments, the fuel injector 50 (350) and the ignition 60 (160) may alternatively be interchanged. For example, in the first preferred embodiment, the ignition may extend in the direction A1 on the B1 side relative to the center O (the centerline O2) of the combustion chamber C. The fuel injector may be inclined in the direction Z2 with respect to the direction A on the Z2 side relative to the center O (the centerline O1) of the combustion chamber C.

While the fuel injector 50 (350) is preferably provided on the side closer to the intake port 22 (B1 side) in each of the first to fourth preferred embodiments described above, the present invention is not restricted to this. The fuel injector may alternatively be provided on a side closer to the exhaust port.

While the injection portion 51 is preferably disposed on the centerline O1 that passes through the center O of the combustion chamber C (central region C1) and extends in the direction B (second direction) in each of the first to fourth preferred embodiments described above, the present invention is not restricted to this. The injection portion may alternatively be disposed above or below the centerline that extends in the second direction instead of on the centerline that extends in the second direction so far as the same is disposed in the central region. In this case, the injection portion is preferably disposed near the centerline that extends in the second direction. In addition, the injection portion is preferably spaced sufficiently apart from the ignition portion in the upward-downward direction. When the ignition portion is disposed on a first side in the upward-downward direction with respect to the center of the combustion chamber in the second direction, for example, the injection portion is preferably disposed on a second side in the upward-downward direction with respect to the center of the combustion chamber in the second direction.

While the ignition portion 61 (161) is preferably disposed on the B2 side (side closer to the exhaust port 23) relative to the centerline O2 that passes through the center O of the combustion chamber C (central region C1) and extends in the direction Z (upward-downward direction) in each of the first to fourth preferred embodiments described above, the present invention is not restricted to this. The ignition portion may alternatively be disposed on the centerline of the combustion chamber that extends in the upward-downward direction or may alternatively be disposed on the side closer to the intake port relative to the centerline that extends in the upward-downward direction so far as the same is disposed in the central region. In addition, the ignition portion is preferably spaced sufficiently apart from the injection portion in the upward-downward direction.

While preferred embodiments of the present invention are preferably applied to the multi-valve engine 1 (101, 201, 301) (internal combustion engine) including the pair of intake openings 22*a* and the pair of exhaust openings 23*a*, in which valves are disposed, for one combustion chamber C in each of the first to fourth preferred embodiments described above, the present invention is not restricted to this. Preferred embodiments of the present invention may alternatively be applied to a single-valve internal combustion engine including one intake opening and one exhaust opening, in which valves are disposed, for one combustion chamber. In this case, the injection portion of the fuel injector and the ignition portion of the ignition are deviated from each other in the upward-downward direction in a central region between one intake opening and one exhaust opening.

While the injection portion 51 of the fuel injector 50 (350) is preferably directly exposed in the combustion chamber C in each of the first to fourth preferred embodiments described above, the present invention is not restricted to this. The injection portion of the fuel injector may alternatively be disposed in the insertion hole (insertion hole 20*c* in FIG. 5) of the cylinder head so as not to be exposed in the combustion chamber. In this case, the injection direction of the fuel injected from the injection portion is adjusted by adjusting the orientation of the insertion hole, for example. It is necessary to locate an opening of the insertion hole closer to the combustion chamber in the central region of the combustion chamber.

While the ignition 60 (160) is preferably inclined with respect to the direction A (first direction in which the cylinder extends) along the upward-downward direction in each of the first to fourth preferred embodiments described above, the present invention is not restricted to this. The inclination direction of the ignition is not particularly restricted. For example, the ignition may alternatively be inclined in the second direction other than the upward-downward direction. The ignition is preferably inclined in the direction away from the fuel injector.

While the fuel injector 350 is preferably inclined with respect to the direction A along the direction B (second direction) in the fourth preferred embodiment described above, the present invention is not restricted to this. The inclination direction of the fuel injector is not particularly restricted. For example, the fuel injector may alternatively be inclined in the upward-downward direction other than along the second direction. The fuel injector is preferably inclined in a direction away from the ignition.

While preferred embodiments of the present invention have been described above, it is to be understood that variations and modifications will be apparent to those skilled in the art without departing from the scope and spirit of the present invention. The scope of the present invention, therefore, is to be determined solely by the following claims.

What is claimed is:

1. An outboard motor comprising:

an internal combustion engine;

a cowling in which the internal combustion engine is housed; and a propulsion unit that converts a rotational drive force of the internal combustion engine into a thrust force; wherein the internal combustion engine includes:

a cylinder head including an intake opening through which intake air is introduced into a combustion chamber of a cylinder and an exhaust opening through which exhaust gas is discharged from the combustion chamber;

a plurality of valves that open and close the intake opening and the exhaust opening;

a pair of valve actuators each including a valve actuating shaft and that transmit a drive force to the plurality of valves;

a fuel injector mounted in the cylinder head and including an injection portion that injects fuel from a central region of the combustion chamber between the intake opening and the exhaust opening into the combustion chamber; and an ignition mounted in the cylinder head and including an ignition portion deviated in an upward-downward direction, in which the valve actuating shaft extends, with respect to the injection portion in the central region and that provides ignition within the combustion chamber; and at least one of the fuel injector and the ignition is inclined in the upward-downward direction which the valve actuating shaft extends.

2. The outboard motor according to claim 1, wherein at least one of the fuel injector and the ignition is inclined with respect to a first direction, in which the cylinder of the internal combustion engine extends, along the upward-downward direction between the pair of valve actuators in the cylinder head.

3. The outboard motor according to claim 2, wherein the ignition is inclined away from the fuel injector along the upward-downward direction between the pair of valve actuators in the cylinder head.

4. The outboard motor according to claim 1, wherein the ignition portion is deviated in the upward-downward direction from a center of the combustion chamber in the upward-downward direction.

5. An outboard motor comprising:

an internal combustion engine;

a cowling in which the internal combustion engine is housed; and a propulsion unit that converts a rotational drive force of the internal combustion engine into a thrust force; wherein the internal combustion engine includes:

a cylinder head including an intake opening through which intake air is introduced into a combustion chamber of a cylinder and an exhaust opening through which exhaust gas is discharged from the combustion chamber;

a plurality of valves that open and close the intake opening and the exhaust opening;

a pair of valve actuators each including a valve actuating shaft and that transmit a drive force to the plurality of valves;

a fuel injector mounted in the cylinder head and including an injection portion that injects fuel from a central region of the combustion chamber between the intake opening and the exhaust opening into the combustion chamber; and an ignition mounted in the cylinder head and including an ignition portion deviated in an upward-downward direction, in which the valve actuating shaft extends, with respect to the injection portion in the central region and that provides ignition within the combustion chamber;

the ignition portion is deviated in the upward-downward direction from a center of the combustion chamber in the upward-downward direction; and the injection portion is deviated in a second direction, which is perpendicular or substantially perpendicular to the upward-downward direction, from a center of the combustion chamber in the second direction, along or near a centerline that passes through the center of the combustion chamber in the upward-downward direction and extends in the second direction.

6. The outboard motor according to claim 5, wherein the intake opening and the exhaust opening are respectively provided on a first side and a second side in the second direction with respect to the center of the combustion chamber in the second direction; and the injection portion is deviated to the first side in the second direction with respect to the center of the combustion chamber in the second direction.

7. The outboard motor according to claim 1, wherein the fuel injector extends in a first direction, in which the cylinder of the internal combustion engine extends, between the pair of valve actuators in the cylinder head.

8. An outboard motor comprising:

an internal combustion engine;

a cowling in which the internal combustion engine is housed; and a propulsion unit that converts a rotational drive force of the internal combustion engine into a thrust force; wherein the internal combustion engine includes:

a cylinder head including an intake opening through which intake air is introduced into a combustion chamber of a cylinder and an exhaust opening through which exhaust gas is discharged from the combustion chamber;

a plurality of valves that open and close the intake opening and the exhaust opening;

a pair of valve actuators each including a valve actuating shaft and that transmit a drive force to the plurality of valves;

a fuel injector mounted in the cylinder head and including an injection portion that injects fuel from a central region of the combustion chamber between the intake opening and the exhaust opening into the combustion chamber; and an ignition mounted in the cylinder head and including an ignition portion deviated in an upward-downward direction, in which the valve actuating shaft extends, with respect to the injection portion in the central region and that provides ignition within the combustion chamber;

the internal combustion engine further includes a valve actuator lid that covers the pair of valve actuators; and the fuel injector is inclined with respect to a first direction, in which the cylinder of the internal combustion engine extends, along a second direction, which is perpendicular or substantially perpendicular to the upward-downward direction, such that the fuel injector avoids the pair of valve actuators and the valve actuator lid between the pair of valve actuators in the cylinder head.

9. The outboard motor according to claim 3, wherein the ignition includes:

a first ignition including a first ignition portion deviated to a first side in the upward-downward direction with respect to the injection portion in the central region and that provides ignition within the combustion chamber, the first ignition inclined away from the fuel injector toward the first side in the upward-downward direction between the pair of valve actuators in the cylinder head; and a second ignition including a second ignition portion deviated to a second side in the upward-downward direction with respect to the injection portion in the central region and that provides ignition within the combustion chamber, the second ignition inclined away from the fuel injector toward the second side in the upward-downward direction between the pair of valve actuators in the cylinder head.

10. An outboard motor comprising:

an internal combustion engine;

a cowling in which the internal combustion engine is housed; and a propulsion unit that converts a rotational drive force of the internal combustion engine into a thrust force; wherein the internal combustion engine includes:

a cylinder head including an intake opening through which intake air is introduced into a combustion chamber of a cylinder and an exhaust opening through which exhaust gas is discharged from the combustion chamber;

a plurality of valves that open and close the intake opening and the exhaust opening;

a pair of valve actuators each including a valve actuating shaft and that transmit a drive force to the plurality of valves;

a fuel injector mounted in the cylinder head and including an injection portion that injects fuel from a central region of the combustion chamber between the intake opening and the exhaust opening into the combustion chamber; and an ignition mounted in the cylinder head and including an ignition portion deviated in an upward-downward direction, in which the valve actuating shaft extends, with respect to the injection portion in the central region and that provides ignition within the combustion chamber;

the intake opening includes a pair of intake openings provided on a first side in a second direction, which is perpendicular or substantially perpendicular to the upward-downward direction, with respect to a center of the combustion chamber in the second direction;

the exhaust opening includes a pair of exhaust openings provided on a second side in the second direction with respect to the center of the combustion chamber in the second direction; and the central region of the combustion chamber is provided in a region surrounded by the pair of intake openings and the pair of exhaust openings.

11. The outboard motor according to claim 10, wherein the injection portion injects the fuel into the combustion chamber from between the pair of intake openings provided on the first side in the second direction with respect to the center of the combustion chamber in the second direction, or from between the pair of exhaust openings provided on the second side in the second direction with respect to the center of the combustion chamber in the second direction; and the ignition portion is disposed between the intake opening and the exhaust opening provided on a first side in the upward-downward direction with respect to a center of the combustion chamber in the upward-downward direction.

12. The outboard motor according to claim 11, wherein the injection portion injects the fuel into the combustion chamber from between the pair of intake openings provided on the first side in the second direction with respect to the center of the combustion chamber in the second direction.

13. The outboard motor according to claim 1, wherein the valve actuators are direct-acting valve actuators including a plurality of cams that come into contact with cam contacts of the plurality of valves, respectively.

14. The outboard motor according to claim 1, wherein the internal combustion engine is a V-shaped internal combustion engine.

15. The outboard motor according to claim 2, wherein the internal combustion engine is housed in the cowling such that a plurality of the cylinders are aligned in the upward-downward direction.

16. A marine vessel comprising:

a vessel body; and an outboard motor mounted on the vessel body, the outboard motor including:

an internal combustion engine;

a cowling in which the internal combustion engine is housed; and a propulsion unit that converts a rotational drive force of the internal combustion engine into a thrust force; wherein the internal combustion engine includes:

a cylinder head including an intake opening through which intake air is introduced into a combustion chamber of a cylinder and an exhaust opening through which exhaust gas is discharged from the combustion chamber;

a plurality of valves that open and close the intake opening and the exhaust opening;

a pair of valve actuators each including a valve actuating shaft and that transmit a drive force to the plurality of valves;

a fuel injector mounted in the cylinder head and including an injection portion that injects fuel from a central region of the combustion chamber between the intake opening and the exhaust opening into the combustion chamber; and an ignition mounted in the cylinder head and including an ignition portion deviated in an upward-downward direction, in which the valve actuating shaft extends, with respect to the injection portion in the central region and that provides ignition within the combustion chamber; and at least one of the fuel injector and the ignition is inclined in the upward-downward direction which the valve actuating shaft extends.

17. The marine vessel according to claim 16, wherein at least one of the fuel injector and the ignition is inclined with respect to a first direction, in which the cylinder of the internal combustion engine extends, along the upward-downward direction between the pair of valve actuators in the cylinder head.

18. The marine vessel according to claim 17, wherein the ignition is inclined away from the fuel injector along the upward-downward direction between the pair of valve actuators in the cylinder head.

19. The marine vessel according to claim 16, wherein the ignition portion is deviated in the upward-downward direction from a center of the combustion chamber in the upward-downward direction.

20. The marine vessel according to claim 19, wherein the injection portion is deviated in a second direction, which is perpendicular or substantially perpendicular to the upward-downward direction, from a center of the combustion chamber in the second direction, along or near a centerline that passes through the center of the combustion chamber in the upward-downward direction and extends in the second direction.

* * * * *